US005775381A

United States Patent [19]

Addis

[11] Patent Number: 5,775,381

[45] Date of Patent: Jul. 7, 1998

[54] BIAS YARN ASSEMBLY FORMING DEVICE

[75] Inventor: Stephen Robert Addis, Crumlin County Antrim, Northern Ireland

[73] Assignee: Short Brothers PLC, Belfast, Northern Ireland

[21] Appl. No.: 633,786

[22] PCT Filed: Aug. 15, 1995

[86] PCT No.: PCT/GB95/01921

§ 371 Date: Jul. 15, 1996

§ 102(e) Date: Jul. 15, 1996

[87] PCT Pub. No.: WO96/06213

PCT Pub. Date: Feb. 29, 1996

[30] Foreign Application Priority Data

Aug. 18, 1994 [GB] United Kingdom ..... 9416721

[51] Int. Cl.[6] ..... D03D 41/00

[52] U.S. Cl. ..... 139/11; 139/DIG. 1; 442/204

[58] Field of Search ..... 139/11, DIG. 1; 442/204, 205

[56] References Cited

U.S. PATENT DOCUMENTS

| | | | |
|---|---|---|---|
| 3,799,209 | 3/1974 | Dow et al. . | |
| 5,137,058 | 8/1992 | Anahara et al. . | |
| 5,204,157 | 4/1993 | Matsumiya | 139/DIG. 1 |
| 5,435,352 | 7/1995 | Yamamoto et al. | 139/DIG. 1 |
| 5,540,260 | 7/1996 | Mood | 139/DIG. 1 |

FOREIGN PATENT DOCUMENTS

| | | |
|---|---|---|
| 0 263 392 | 4/1988 | European Pat. Off. . |
| 2 479 859 | 10/1981 | France . |
| 2 681 553 | 3/1993 | France . |
| 2 319 822 | 10/1973 | Germany . |
| WO 92 14876 | 9/1992 | WIPO . |
| WO 94 16131 | 7/1994 | WIPO . |

*Primary Examiner*—Andy Falik
*Attorney, Agent, or Firm*—Kenyon & Kenyon

[57] ABSTRACT

A device for forming from warp sheet a bias yarn assembly comprising two superposed bias yarn sub-assemblies in which the bias yarns of one sub-assembly are inclined to the bias yarns of the other sub-assembly and in both of which the bias yarns are inclined to the warp feed direction includes a yarn transfer mechanism having a lower yarn guide member with upstanding yarn guide elements which extend through the thickness of the warp sheet and define warp yarn guide openings through which the warp yarns of the warp sheet pass and which hold the warp yarns in positions spaced apart in the weft direction and an upper yarn transfer member which includes yarn guide elements which extend downwardly and which define transfer openings for the reception of yarns of the warp sheet from the yard guide openings for transfer to the other yarn guide openings. The warp yarns of the warp sheet are arranged to pass through eyelet elements which are supported by guide elements for sliding movement along the guide elements and which protect the yarns during yarn movements from one opening in one member into a registering opening in the other member.

19 Claims, 20 Drawing Sheets

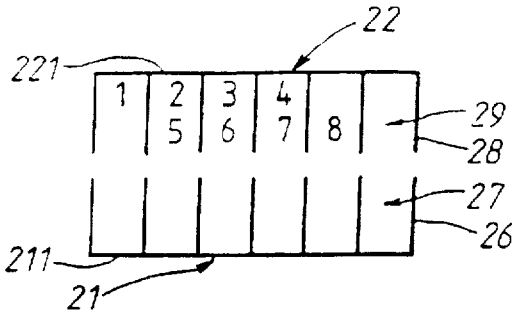
Fig.3A(i)
PRIOR ART
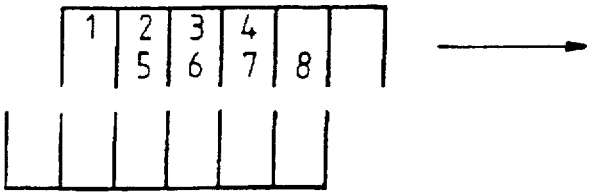
Fig.3A(ii)
PRIOR ART
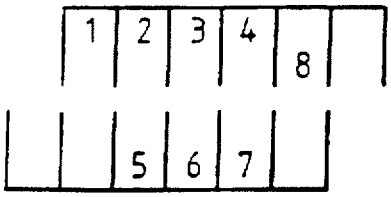
Fig.3A(iii)
PRIOR ART
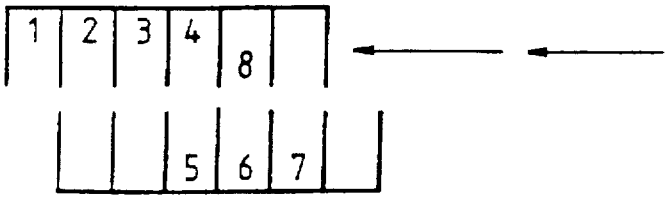
Fig.3A(iv)
PRIOR ART
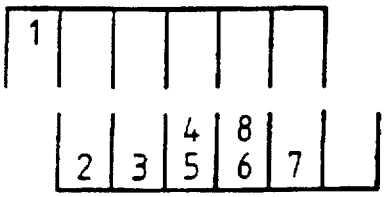
Fig.3A(v)
PRIOR ART
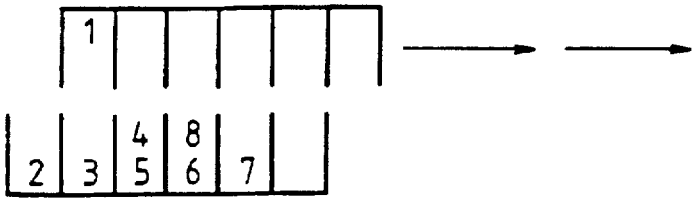
Fig.3A(vi)
PRIOR ART Fig.3A(vii)
PRIOR ART
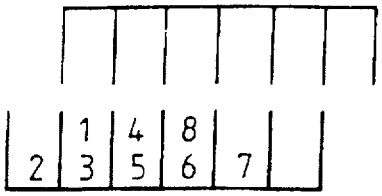
Fig.3A(viii)
PRIOR ART
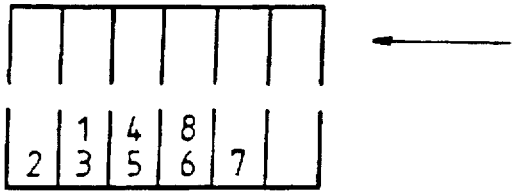
Fig.3B(i)
PRIOR ART
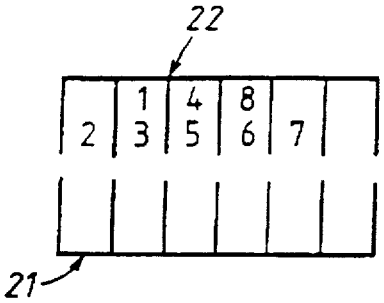
Fig.3B(ii)
PRIOR ART
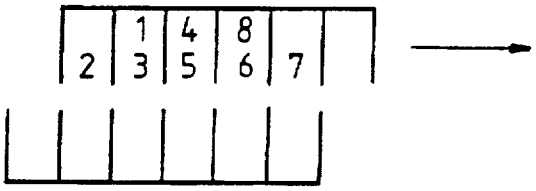
Fig.3B(iii)
PRIOR ART
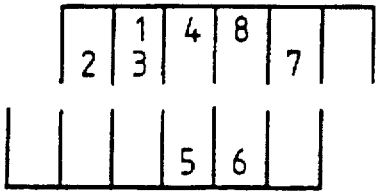
Fig.3B(iv)
PRIOR ART
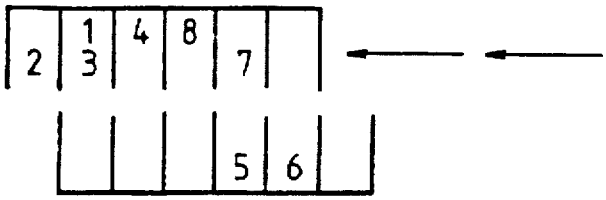

Fig.3B(vi)
PRIOR ART

Fig.3B(vii)
PRIOR ART

Fig.3B(viii)
PRIOR ART

Fig.3C(ii)
PRIOR ART

Fig.3C(iii)
PRIOR ART
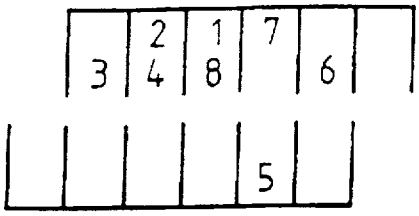
Fig.3C(iv)
PRIOR ART
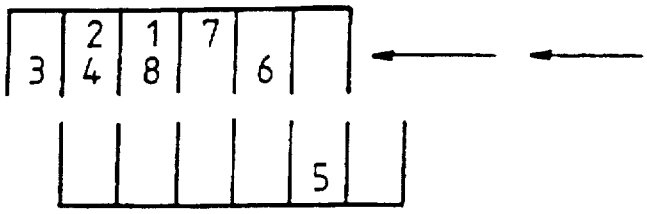
Fig.3C(v)
PRIOR ART
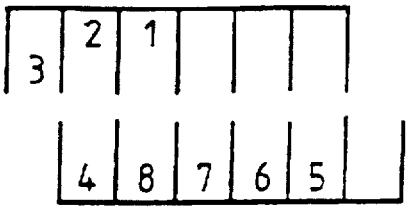
Fig.3C(vi)
PRIOR ART
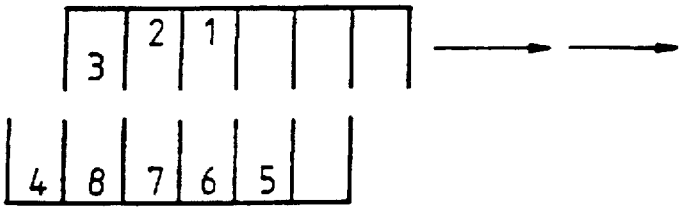
Fig.3C(vii)
PRIOR ART
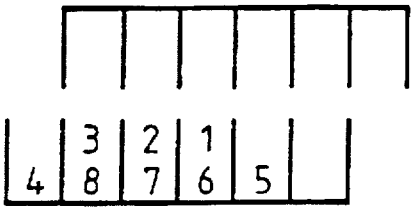
Fig.3C(viii)
PRIOR ART
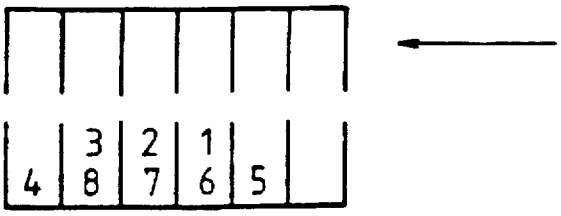

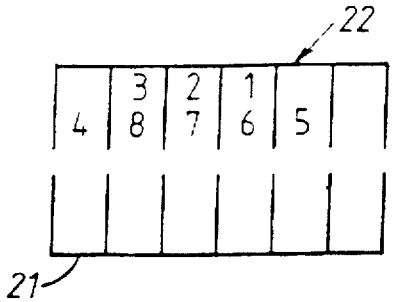
Fig.3D(i)
PRIOR ART
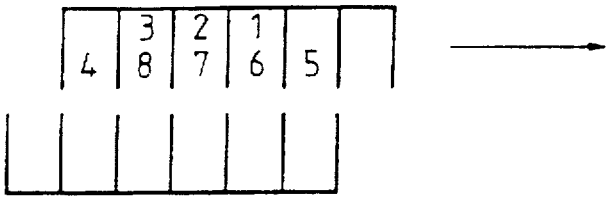
Fig.3D(ii)
PRIOR ART
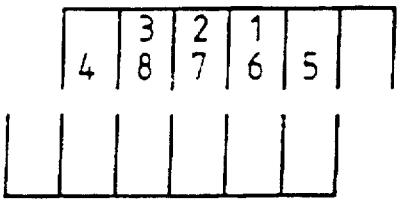
Fig.3D(iii)
PRIOR ART
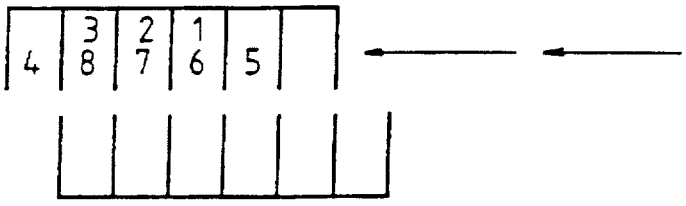
Fig.3D(iv)
PRIOR ART
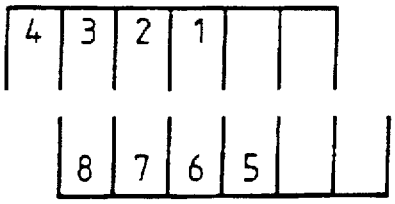
Fig.3D(v)
PRIOR ART
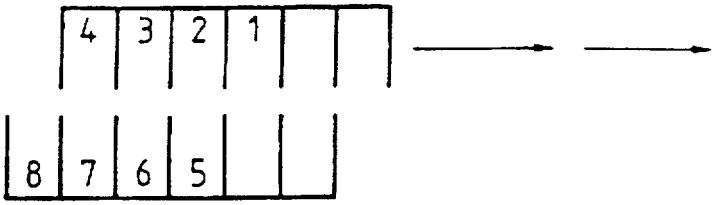
Fig.3D(vi)
PRIOR ART Fig.3D(vii)
PRIOR ART
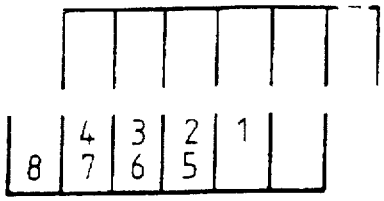
Fig.3D(viii)
PRIOR ART
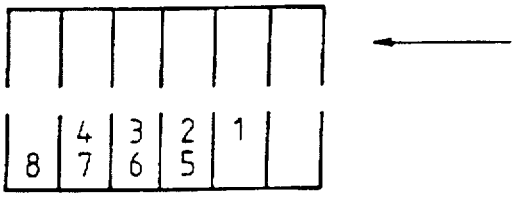
Fig.3E(i)
PRIOR ART
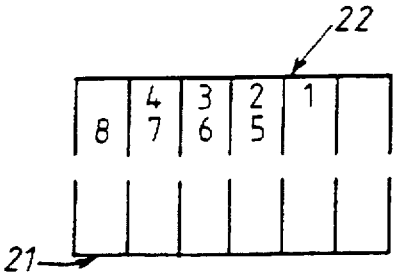
Fig.3E(ii)
PRIOR ART
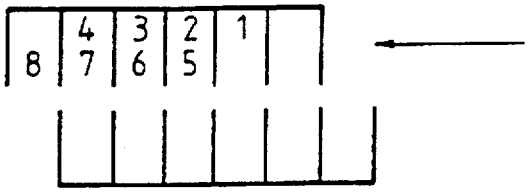
Fig.3E(iii)
PRIOR ART
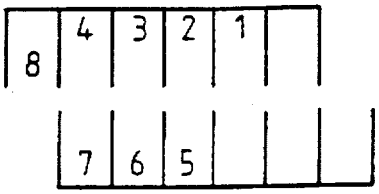
Fig.3E(iv)
PRIOR ART
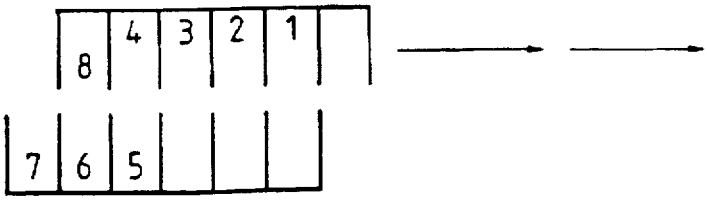

Fig.3E(vi)
PRIOR ART

Fig.3E(vii)
PRIOR ART

Fig.3E(viii)
PRIOR ART

Fig.3F(ii)
PRIOR ART

Fig.3F(iii)
PRIOR ART
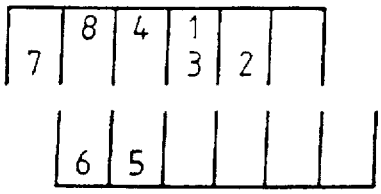
Fig.3F(iv)
PRIOR ART
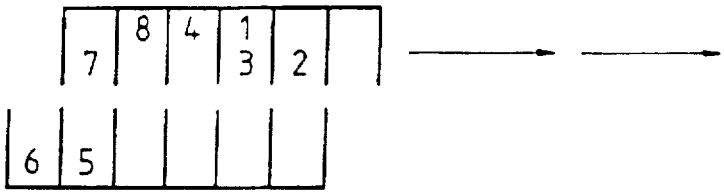
Fig.3F(v)
PRIOR ART
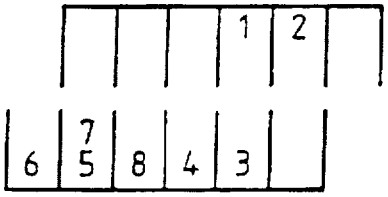
Fig.3F(vi)
PRIOR ART
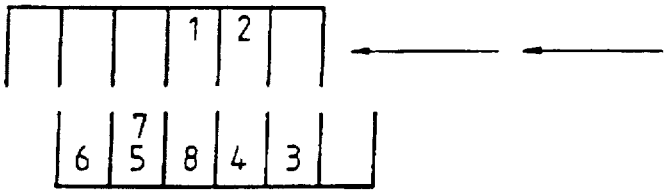
Fig.3F(vii)
PRIOR ART
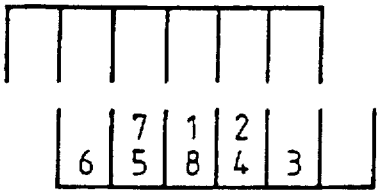
Fig.3F(viii)
PRIOR ART
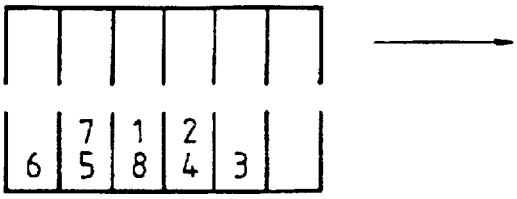

Fig.3G(ii)
PRIOR ART

Fig.3G(iii)
PRIOR ART

Fig.3G(iv)
PRIOR ART

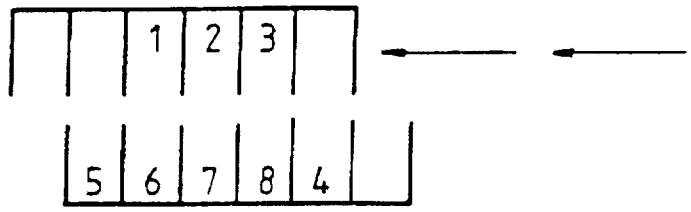
Fig.3G(vi)
PRIOR ART
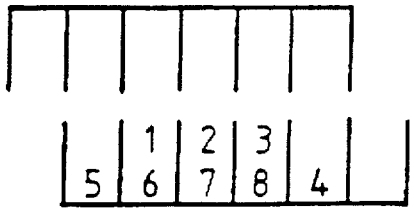
Fig.3G(vii)
PRIOR ART
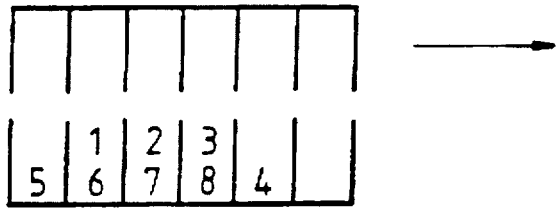
Fig.3G(viii)
PRIOR ART
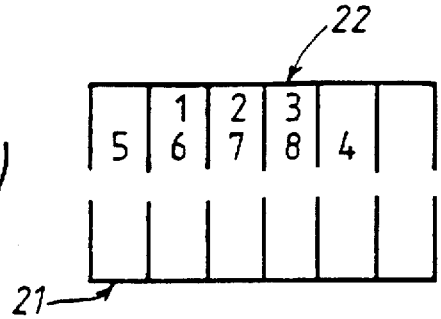
Fig.3H(i)
PRIOR ART
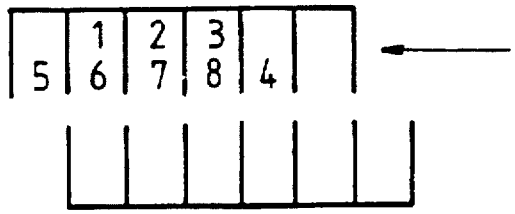
Fig.3H(ii)
PRIOR ART

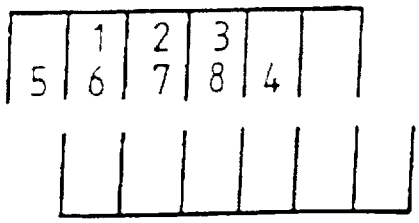
Fig.3H(iii)
PRIOR ART
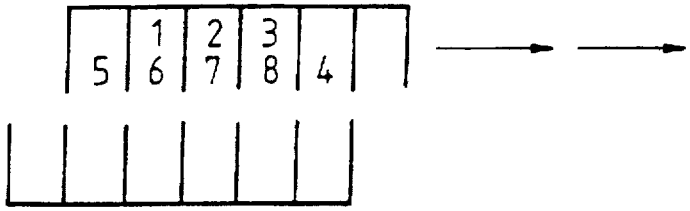
Fig.3H(iv)
PRIOR ART
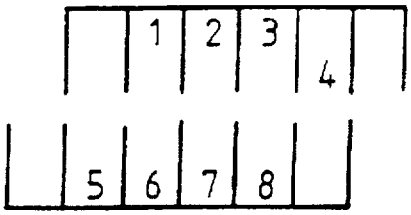
Fig.3H(v)
PRIOR ART
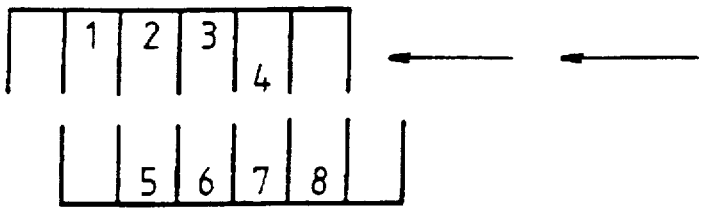
Fig.3H(vi)
PRIOR ART
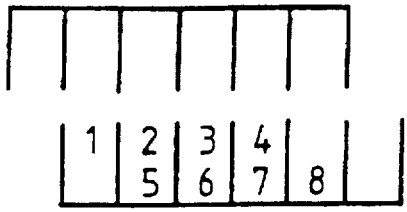
Fig.3H(vii)
PRIOR ART
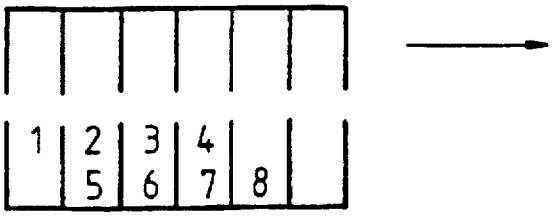
Fig.3H(viii)
PRIOR ART

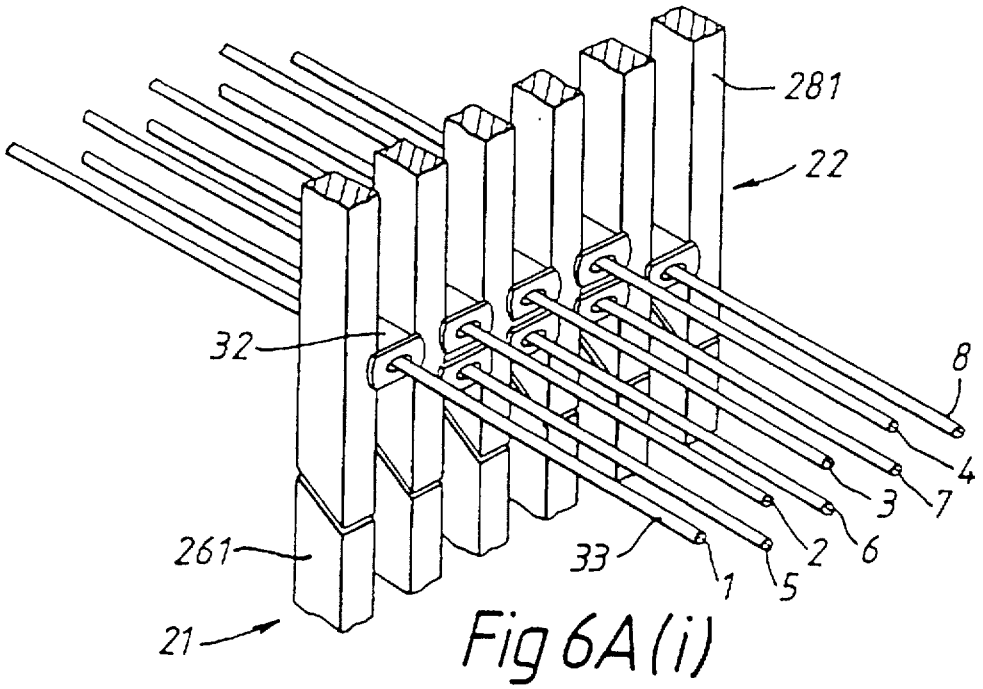
Fig 6A (i)
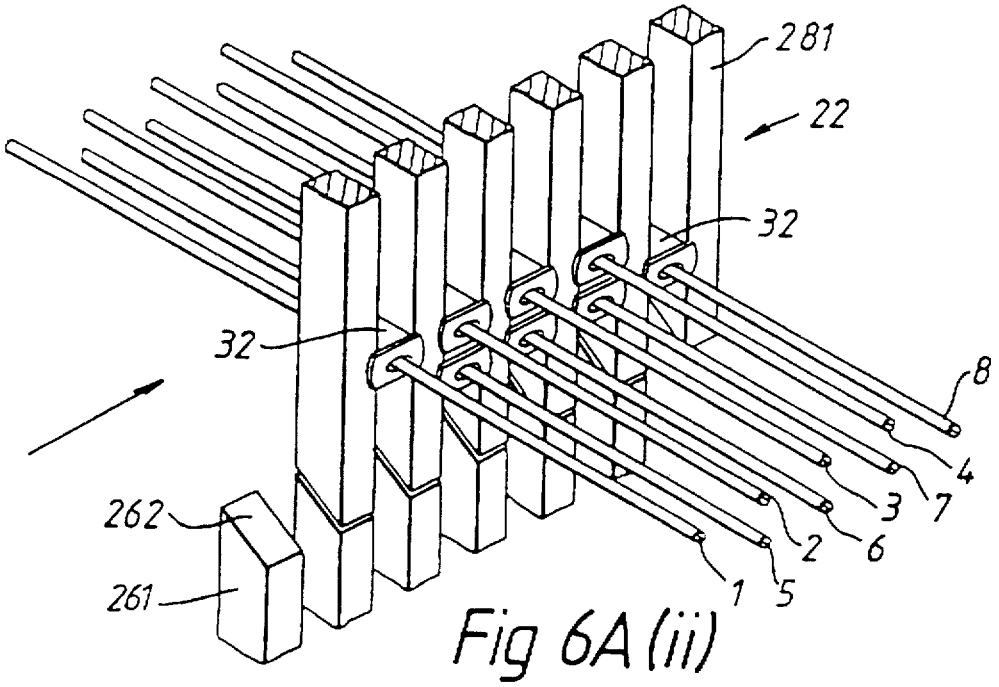
Fig 6A (ii)

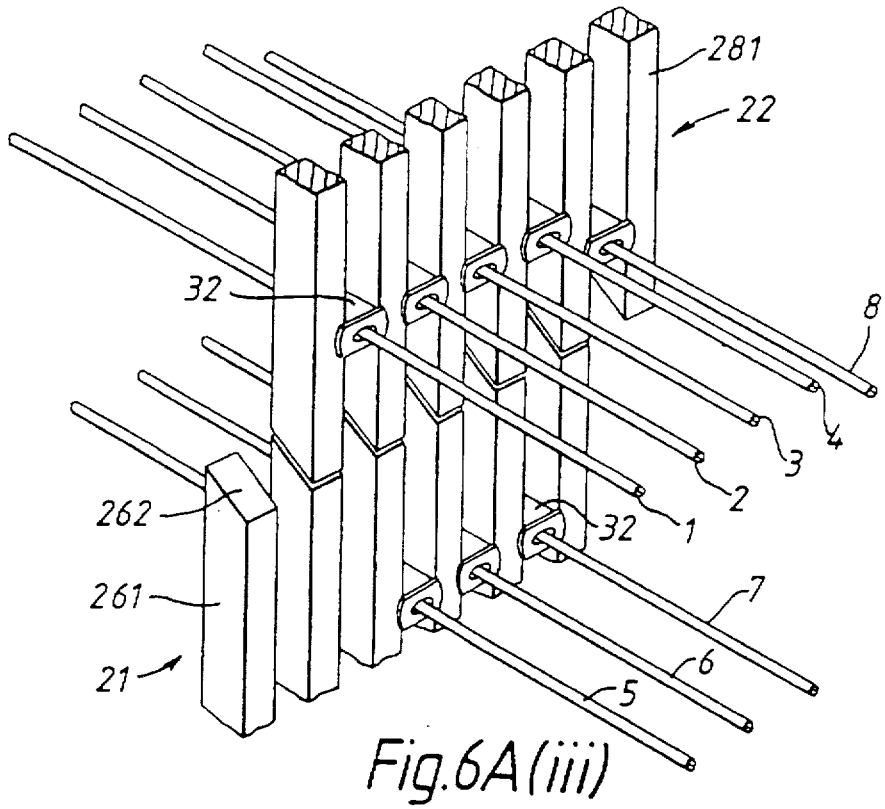
Fig.6A(iii)
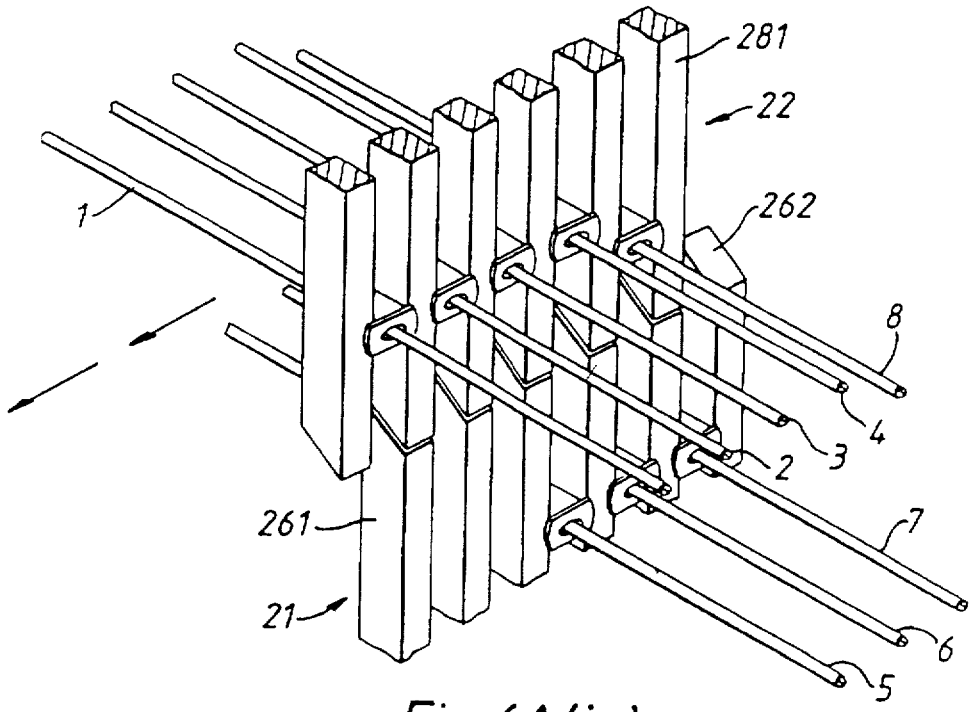
Fig.6A(iv)

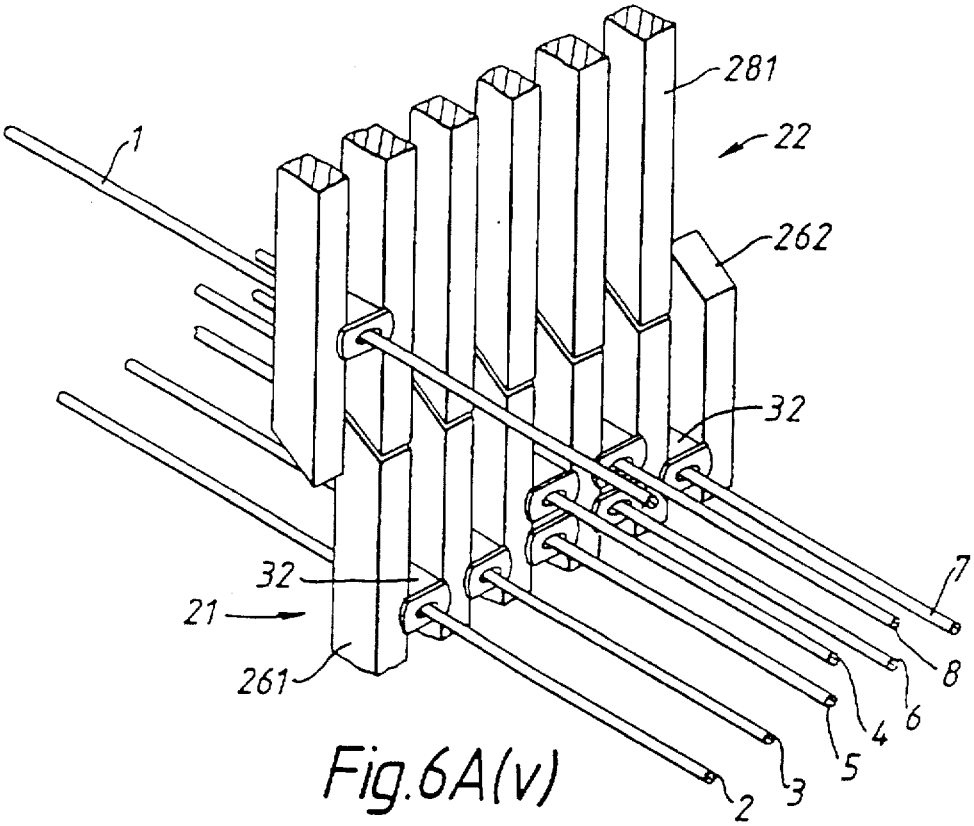
Fig.6A(v)
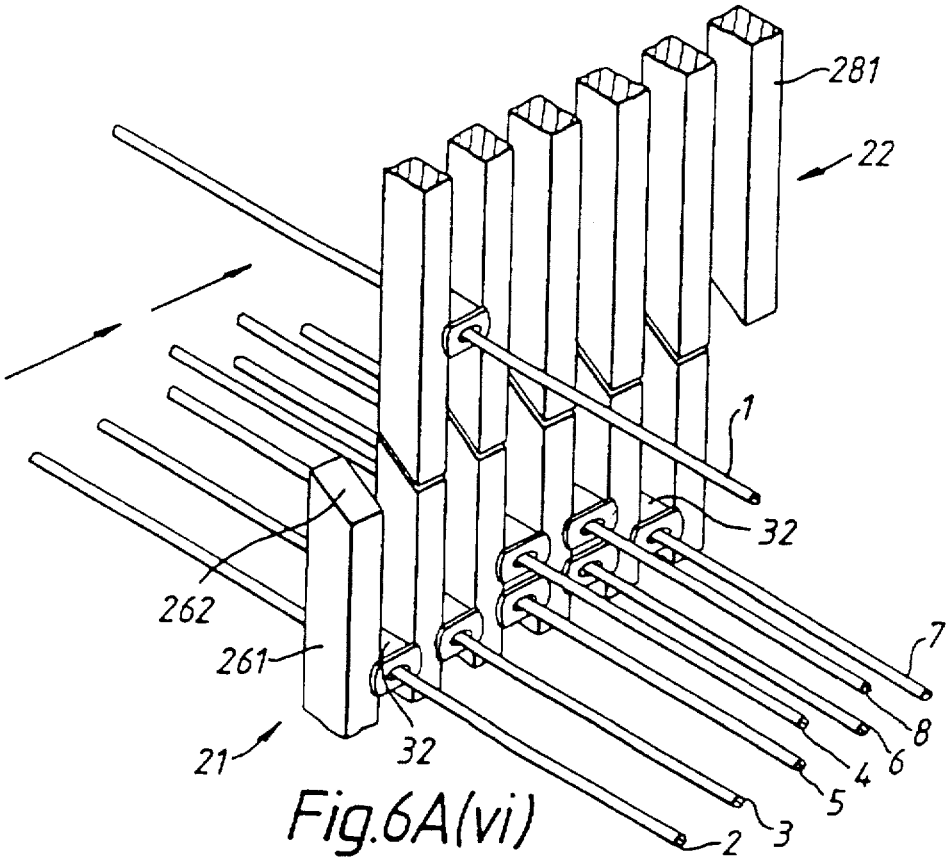
Fig.6A(vi)

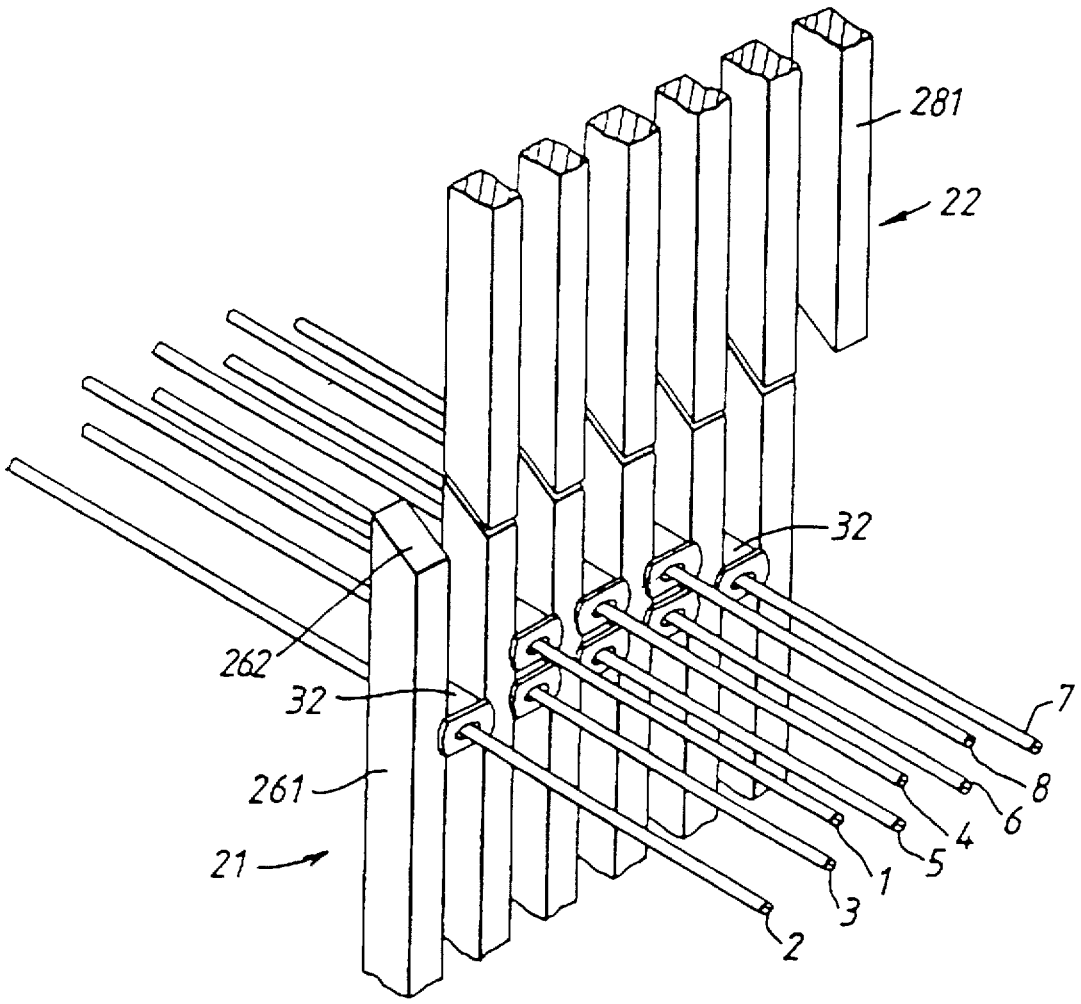
Fig.6A(vii)

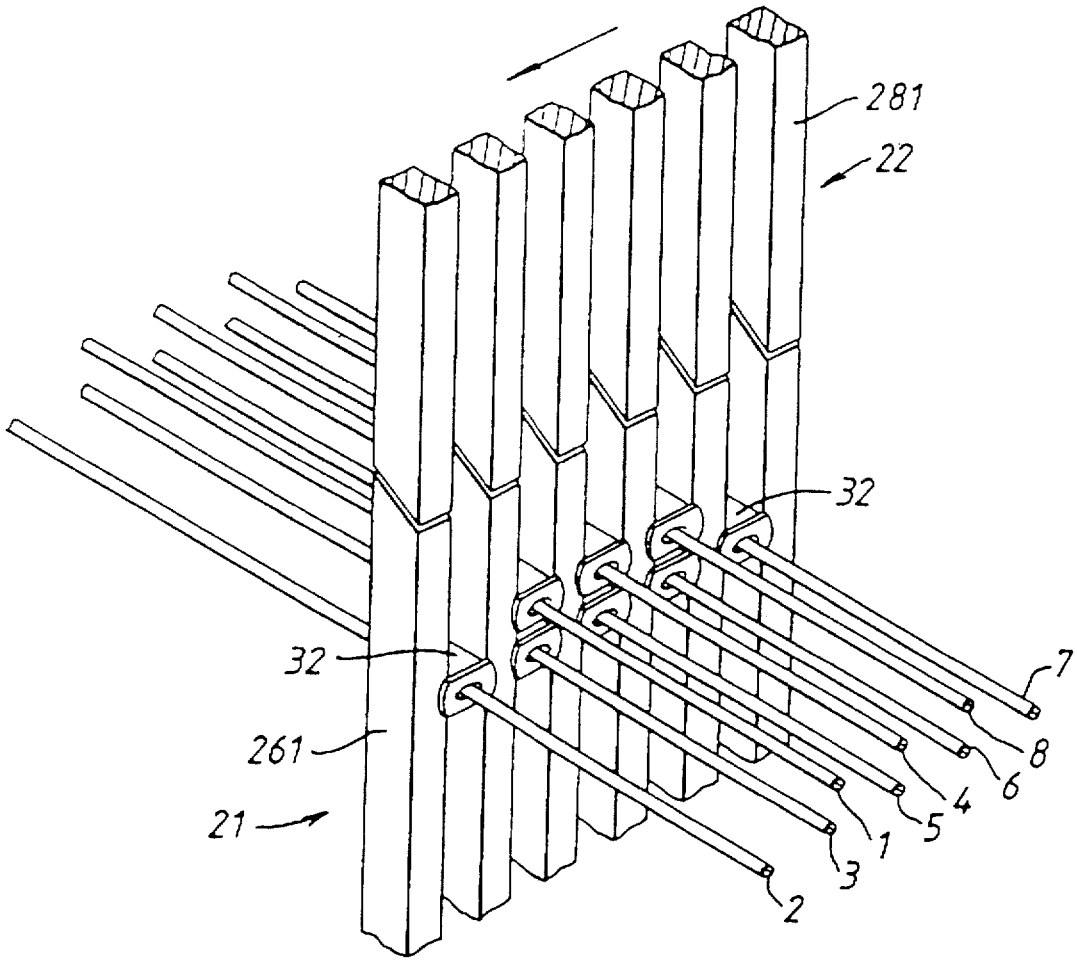
Fig.6A(viii)

BIAS YARN ASSEMBLY FORMING DEVICE

BACKGROUND OF THE INVENTION

1. Field of the Invention

The present invention relates to a bias yarn assembly forming device for forming in a succession of bias yarn forming steps in which warp yarns of a warp sheet are displaced in opposite weft directions a bias yarn assembly comprising two superposed bias yarn sub-assemblies in which the bias yarns of one sub-assembly are inclined to the bias yarns of the other sub-assembly and in both of which the bias yarns are inclined to the warp feed direction.

By yarn is meant a continuous monofilament, an assembly of continuous filaments in the form of a tow or twisted together or a yarn spun from short fibres.

By warp feed direction is meant the direction in which warp yarns are fed and which is orthogonal to weft yarns in the structure being formed.

2. Description of the Prior Art

In U.S. Pat. No. 5,137,058 there is disclosed a machine for forming a three dimensional fabric embodying warp yarns, weft yarns, and non-woven bias yarns which are held together by binding warp yarns which pass through the yarn structure between adjacent warp yarns and which are held captive at the outer faces of the structure by weft yarns inserted at each face. The machine includes a bias yarn traversing device for progressively traversing yarns fed to it to provide sub-assemblies of oppositely inclined bias yarns which are fed into the weaving zone where they are held in place with the warp and weft yarns by the binding warp yarns.

In one form of bias yarn traversing device disclosed in U.S. Pat. No. 5,137,058, the warp yarns supplied to the device are passed through holes in an arrangement of guide blocks with one block for each yarn and the blocks are caused to move continuously first along an upper horizontal run in which each block follows the one-preceding it and each block on arrival at the end of the run is transferred to a lower horizontal run where it is progressively displaced in the opposite direction along the lower run until it reaches the end of the lower run where it is then moved back into the upper run. The traversing device in this form requires the use of a rotating yarn supply creel which takes the form of an endless belt or chain which supports the bias yarn supply packages and causes them to follow the movement of the bias yarns in the bias yarn traversing device. The traversing device, however, suffers the disadvantage that it requires a cumbersome endless belt creel for supporting the large plurality of supply packages.

In WIPO publication WO92/14876 a method of forming a three-dimensional woven fabric is disclosed in which use is made of a yarn transfer device for transferring yarns in the weft direction to provide bias yarn arrays in which the yarns are inclined to the warp feed direction and in which the arrays of inclined bias yarns are woven into other arrays of yarns by selective shedding of the yarns and insertion of weft yarns to produce the three-dimensional fabric. In this method, each yarn which is to form a bias yarn needs to be detachably engaged by a yarn engaging heald for selectively raising and lowering the yarn during the weaving process.

International patent application No. PCT/GB94/00028 (publication No. WO94/16131) discloses a machine for producing a multi-axial yarn structure which utilises a yarn transfer device for forming a non-woven bias yarn assembly of two superposed non-woven bias yarn sub-assemblies, but which does not require the use of a rotary creel or its equivalent for the supply of bias yarns and in which repeated engagement and disengagement of yarns from healds in the weaving process disclosed in WO92/14876 can be avoided.

The machine disclosed in PCT/GB94/00028 for forming the multi-axial yarn structure comprises supply means for supplying in a warp feed direction warp yarns in the form of a warp sheet, and bias yarn forming means for forming the non-woven bias yarn assembly of two superposed non-woven bias yarn sub-assemblies.

A simple form of three-dimension yarn structure which can be produced on the yarn structure forming machine disclosed in PCT/GB94/00028 is schematically illustrated in FIG. 1 of the accompanying drawings and comprises a non-woven warp yarn assembly composed of two superposed non-woven diagonal sub-assemblies of warp yarns 11 and 12 arranged at angles of ±45° to the reference warp direction R, a binding warp yarn assembly comprising binding warp yarns 13 extending in the warp feed direction and passing through the non-woven diagonal warp yarn sub-assemblies 11 and 12, an upper weft yarn assembly comprising weft yarns 14 and a lower weft yarn assembly comprising weft yarns 15.

One form of yarn structure forming machine disclosed in PCT/GB94/00028 for forming the yarn structure of FIG. 1 is shown in FIG. 2 of the accompanying drawings and comprises a creel 16 which supplies warp yarns in a warp sheet 17 in a warp feed direction F to a yarn transfer mechanism 18 following passage through yarn support elements 19 of a jacquard mechanism 20. Each warp yarn of the warp sheet 17 is supported by its own yarn support element 19 which can be raised and lowered under the control of the mechanism 20 to form sheds in which warp yarns of the warp sheet 17 are raised. Such mechanisms are well known in the art and although they can be used for making complex selections for the shedding of the warp sheet in the formation of fabrics of intricate pattern the mechanism provided in the machine illustrated in FIG. 2 is also employed for raising and lowering warp yarns of the warp sheet 17 during yarn transfer carried out by a yarn transfer mechanism 18 to form the bias yarns and to shed the bias yarns thus formed.

The yarn transfer mechanism 18 comprises a lower yarn guide member 21 which extends in the weft direction throughout the width of the warp sheet 17 and includes upstanding yarn guide elements which extend through the thickness of the warp sheet 17 and define warp yarn guide openings through which the warp yarns of the warp sheet 17 pass and which hold the warp yarns in predetermined positions spaced apart in the weft direction and a warp yarn transfer member 22 which also extends in the weft direction and which includes yarn guide elements defining transfer openings for the reception of yarns of the warp sheet 17 for transfer in producing the bias yarns 11 and 12 which are to form part of the yarn structure produced on the machine.

The machine shown in FIG. 2 also includes a weft insertion station 23 for inserting the weft yarns 14 of the structure shown in FIG. 1 and a binding warp yarn insertion mechanism 25 which includes an insertion needle 26 which provides for the insertion of the binding warp yarns 13 of the structure 10 shown in FIG. 1. It also includes a beater 30.

The yarn transfer mechanism 18 in the machine illustrated in FIG. 2 under the control of drive mechanism 181 serves progressively to move the warp yarns of the warp sheet 17 into diagonal ±45° non-woven warp yarn sub-assemblies as represented by the warp yarns 11 and 12 of the structure shown in FIG. 1. A description of the manner of operation of the mechanism 18 disclosed in PCT/GB94/00028 will now be described with reference to FIGS. 3A(i) to FIG. 3H(viii).

The yarn guide member 21 is schematically illustrated in FIG. 3A(i) and includes a large plurality of upstanding yarn guide elements 26 which extend upwardly from a support portion 211 and which provide yarn guide openings 27 through which warp yarns of the warp sheet 17 pass, with the yarn guide elements 26 serving to hold warp yarns in predetermined positions spaced-apart in the weft direction for subsequent insertion of the binding warp yarns and the insertion of weft yarns. The yarn transfer member 22 takes the same form as the yarn guide member 21 and is provided with a like plurality of yarn guide elements 28 which extend downwardly from a support portion 221 and which define transfer openings 29 to which warp yarns from the guide member 21 can be transferred for their transfer to another yarn guide opening 27 in the yarn guide member 21.

The yarn guide member 21 in FIG. 3A(i) is shown for illustrative purposes with six yarn guide openings and the yarn transfer member 22 is likewise provided with an equal number of yarn transfer openings 29. In the disposition shown in FIG. 3A(i) the yarn transfer member 22 appears in an initial receiving position with the six openings 29 directly opposed to the six openings 27 in the guide member 21. For illustrative purposes, eight yarns only of the yarns required to produce the bias yarn sub-assemblies of the yarn structure to be formed are represented by numerals 1 to 8.

The yarns 1 to 8 will initially have occupied openings in the yarn guide member 21 and in a first forward yarn transfer step to be carried out all the yarns 1 to 8 are transferred to corresponding transfer openings 29 as shown in FIG. 3A(i) during an initial first movement in the first forward yarn transfer step. Accordingly, the first yarn 1 will have occupied before transfer a first end opening in the yarn guide member 21, the last yarn 8 will have occupied an opposite end opening and each of the pair of yarns 2,5; 3,6; and 4,7 will have occupied intermediate openings.

With the yarns located in the yarn transfer member 22 as illustrated in FIG. 3A(i) the yarn transfer member 22 is moved under the control of the drive mechanism 181 illustrated in FIG. 2 one opening in a first weft direction (to the right in the drawing) as illustrated in FIG. 3A(ii). One yarn from each of the intermediate openings which is required to be moved to the right in the figure is then returned to openings in the yarn guide member 21 as illustrated in FIG. 3A(iii) which shows the return of yarns 5, 6 and 7. The yarn transfer member 22 is then moved two openings in an opposite second weft direction (to the left in the figure and as illustrated in FIG. 3A(iv) following which the remaining yarns 2, 3 and 4 from the intermediate openings and the last yarn 8 are returned to openings in the yarn guide member 21 as illustrated in FIG. 3A(v). As will be seen, the first yarn 1 remains in the yarn transfer member 22. The yarn transfer member 22 is then moved two openings in the first weft direction (to the right in the drawing) to the position illustrated in FIG. 3A(vi) following which the first yarn 1 is lowered into the yarn guide member 21 as illustrated in FIG. 3A(vii). The yarn transfer member 22 is then moved one opening in the second weft direction to bring it back to its initial receiving position as illustrated in FIG. 3A (viii).

The movement of yarns carried out in a first forward transfer step described with reference to FIG. 3A(i) to 3A(viii) is then repeated in a second forward transfer step on the yarn configuration appearing in FIG. 3A(viii), that is to say, on a first yarn 2, three intermediate pairs of yarns 1,3; 4,5; and 8,6 and a last yarn 7, as illustrated in FIG. 3B(i) to 3B(viii), except insofar that there is included with the transfer of the first yarn 1 the yarn 2 which has arrived at the first opening in the yarn guide member 21.

Movement of yarns in the second forward transfer step is illustrated in FIG. 3B(i) to 3B(viii). A third forward transfer step is carried out as illustrated in FIG. 3C(i) to FIG. 3C(viii). A fourth forward transfer step is then carried out as illustrated in FIGS. 3D(i) to FIG. 3D(viii), which then brings the yarns as shown in FIG. 3D(viii) into an opposite order in the openings in the yarn guide member 21 with the yarn 1 occupying the last end opening and the yarn 8 in the first end opening.

FIGS. 3D(i) to 3D(viii) show displacements of the yarn transfer member 22 which are consistent with those shown in FIGS. 3A(i) to 3A(viii), FIGS. 3B(i) to 3B(viii) and FIGS. 3C(i) to 3C(viii). It will however be seen that displacements of the yarn transfer member 22 embraced by FIGS. 3D(ii) to 3D(iv) can be replaced by a single displacement of the transfer member 22 one opening to the left in the drawing.

The succession of forward transfer steps as described with reference to FIG. 3A(i) to FIG. 3D(viii) is then followed by a succession of return transfer steps as illustrated in FIG. 3E(i) to FIG. 3H(viii) in each of which movement of the yarn transfer member 22 is reversed and the yarns transferred in opposite weft directions to bring them back into the openings which they occupied at the commencement of the first forward transfer step. The succession of forward transfer steps followed by the succession of return transfer steps is then repeated.

FIGS. 3H(i) to 3H(viii) also show displacements of the yarn transfer member 22 which are consistent with those shown in FIGS. 3E(i) to 3E(viii), FIGS. 3F(i) to 3F(viii) and FIGS. 3G(i) to 3G(viii). It will however be seen that displacements of the yarn transfer member 22 embraced by FIGS. 3H(ii) and 3H(iii) can be replaced by a single displacement of the transfer member 22 one opening to the right in the drawing.

It will be apparent that the transfer of warp yarns carried out as described with reference to FIG. 3A(i) to FIG. 3H(viii) results in the formation of a bias yarn assembly comprising two yarn sub-assemblies inclined to each other and to the warp feed direction without the need for providing a warp yarn supply in the form of a rotary creel. The yarns undergoing transfer in the forward and return transfer steps are however required to move between the openings in the yarn guide member and the yarn transfer member many times in order to complete the succession of forward transfer steps followed by the succession of return transfer steps. In particular, in the first forward transfer step illustrated in FIGS. 3A(i) and 3A(viii) eight yarns are first raised to move them from the yarn guide member 21 to the yarn transfer member 22; three yarns are then lowered as illustrated in FIG. 3A(iii) to transfer to them from the transfer member 22 to the guide member 21 followed by the lowering of four further yarns to transfer them from the yarn transfer member to the yarn guide member as illustrated in FIG. 3A(v) and finally the lowering of a single yarn to transfer it from the yarn transfer member to the yarn guide member as illustrated in FIG. 3A(vii).

As will be apparent, the yarn movements as described in fact amount to the raising of all eight yarns from the yarn guide member 21 to the yarn transfer member 22 and then the lowering of them from the transfer member to the yarn guide member, making a total of 16 yarn excursions in the first forward transfer step. Each of the subsequent forward transfer steps and each of the return transfer steps as illustrated in FIGS. 3B(i) to 3H(viii) require the same number of yarn transfer movements.

While the bias yarn traversing device disclosed in U.S. Pat. No. 5,137,058 makes use of guide blocks through which warp yarns are passed, their purpose is simply to move the yarns continuously first along an upper horizontal run in which each block follows the one preceding it and at the end of which it is transferred to the lower horizontal run where it is progressively displaced in the opposite direction until it reaches the end of the lower run where it is then moved back into the upper run. The traversing device as disclosed however requires the use of a rotating creel which causes the yarn supply packages to follow the movement of the bias yarns in the bias yarn traversing device.

In the yarn transfer mechanism disclosed in PCT/GB94/00028 as described with reference to FIGS. 3A(i) to 3H(viii) while the need for a rotating supply creel is obviated there is a need to make a number of transfer movements of yarn between the yarn guide member 21 and the yarn transfer member 22. As a consequence, it has been found that despite efforts to bring the gaps between opposing guide elements 26 and 28 to minimum tolerances, the warp yarns suffer abrasion when transferred from one member to the other and in some instances snag causing end breaks requiring shutdown of the machine of which the transfer mechanism forms part.

SUMMARY OF THE INVENTION

It is an object of the present invention to provide a bias yarn assembly forming device which can be used as the yarn transfer mechanism disclosed in PCT/GB94/00028, but which does not require contact of the yarns with the guide elements in their transfer between the yarn guide member and the yarn transfer member.

According to the present invention, there is provided a bias yarn assembly forming device for forming in a succession of bias yarn forming steps in which warp yarns of a warp sheet are displaced in opposite weft directions a bias yarn assembly comprising two superposed bias yarn sub-assemblies in which the bias yarns of one sub-assembly are inclined to the bias yarns of the other sub-assembly and in both of which the bias yarns are inclined to the warp feed direction, the device including (i) a yarn transfer mechanism comprising a yarn guide member having a support portion extending in the weft direction and a plurality of guide elements which extend laterally from the support portion to form a row of equi-spaced elements which terminate in ends lying on a line extending in the weft direction and which define between pairs of adjacent guide elements warp yarn guide openings through which warp yarns of the warp sheet are caused to pass and by which the warp yarns are confined to predetermined relative positions therein along the weft direction and a yarn transfer member having a support portion extending in the weft direction and a plurality of guide elements which extend laterally from the support portion to form a row of equi-spaced elements which terminate in ends lying on a line extending in the weft direction and which define between pairs of adjacent guide elements yarn transfer openings to which warp yarns of the warp sheet are transferred and by which the warp yarns are confined to predetermined relative positions therein along the weft direction, (ii) yarn transfer drive means to cause predetermined relative displacements of the yarn transfer member and the yarn guide member in the weft direction to bring the yarn transfer member to any one of a plurality of transfer positions in which ends of the guide elements of the yarn transfer member oppose and register with ends of the guide elements of the yarn guide member and in which transfer openings of yarn transfer member register with yarn guide openings in the yarn guide member and (iii) shedding means on the supply side of the transfer mechanism for shedding selected warp yarns to cause the selected yarns to move from predetermined first yarn guide openings in the yarn guide member to registering yarn transfer openings in the yarn transfer member and following displacement of the yarn transfer member to another of the plurality of the transfer positions to return the selected warp yarns to the warp sheet and into predetermined second yarn guide openings in the yarn guide member offset from the predetermined first yarn guide openings characterised in that the transfer mechanism includes a plurality of eyelet elements through which the warp yarns of the warp sheet pass from a supply side of the device to an opposite delivery side of the device and which are supported by the guide elements for sliding movement along the elements into and out of the yarn guide and yarn transfer openings and with the yarn transfer member in any one of the registering positions for sliding movements from one opening in one member into a registering opening in the other member.

In a preferred embodiment of the invention hereinafter to be described the guide elements of the yarn guide member lie in a first surface, the guide elements of the yarn transfer member lie in a second surface and the yarn transfer member and yarn guide member are so disposed at each of the transfer positions that the first and second surfaces form a continuous surface. Preferably, the guide elements of the yarn transfer member and yarn guide member lie in first and second surfaces which are planar and the yarn transfer and yarn guide members are so disposed that the first and second planar surfaces are co-planar at each transfer position.

In the embodiment of the invention hereinafter to be described the yarn transfer member and the yarn guide member are so mounted and movable that the first and second planar surfaces in which the guide elements of the two members lie are co-planar throughout relative displacement of the two members.

In the embodiment of the invention hereinafter to be described each eyelet element includes a body portion having a bore which extends therethrough and through which one or more warp yarns pass and restraining means restraining the eyelet element to sliding movement on the guide elements in the opening within which the eyelet element is located.

In the embodiment of the invention hereinafter to be described, the restraining means-comprises a front end flange provided on the supply side of the device and having a first guide element engaging portion which extends laterally from the body portion in a first direction to overlap and bear against a front face of one of the adjacent guide elements which define the opening in which the eyelet element is located and a second guide element engaging portion which extends laterally from the body portion in an opposite direction to overlap and bear against the front face of the other of the two adjacent guide elements defining the opening. The restraining means then further comprises a rear end flange provided on the delivery side of the device and having a first guide element engaging portion which extends laterally from the body portion in a first direction to overlap and bear against a rear face of one of the adjacent guide elements which define the opening in which the eyelet element is located and a second guide element engaging portion which extends laterally from the body portion in an opposite direction to overlap and bear against the other of the adjacent guide elements defining the opening. The body portion of the eyelet element preferably so extends laterally within the opening in which the eyelet element is located as to prevent any weftwise or any substantial weftwise movement of the eyelet element within the opening.

In the embodiment of the invention hereinafter to be described the guide element engaging portions of each end flange of each eyelet element, which overlap and bear against the front and rear faces of adjacent guide elements, have guide element engaging surfaces of convex form to facilitate movement of the eyelet element into and out of the openings between adjacent guide elements during transfer of the eyelet element from an opening in one member to an opening in the other member.

In the embodiment of the invention hereinafter to be described the cross-section of the bore within the body portion of each eyelet element is so enlarged in the region of each end of the bore as to reduce the frictional force applied by the walls of the bore to the warp yarns passing through the bore.

In the embodiment of the invention hereinafter to be described, each of the guide elements of the yarn transfer member and the yarn guide member are of square or rectangular cross-section, wherein the body portion of each eyelet element is of rectangular or square section and wherein the width of the body portion of each of the eyelet elements is such as to produce a sliding fit between opposing side faces of adjacent guide elements which define the opening in which the eyelet element lies.

In the embodiment of the invention hereinafter to be described, the bias yarn assembly forming device includes an eyelet element detection device responsive to a retention of an eyelet element at a junction between any one of the yarn guide openings and a transfer opening in registration therewith to prevent a subsequent relative displacement of the yarn transfer and yarn guide members until the eyelet element has been cleared from the junction. The detection device advantageously comprises a beam generator and a beam responsive device so disposed that the beam generator transmits a beam to the beam responsive device along a pathway in which the beam is interrupted by the presence of an eyelet element at any of the junctions.

The guide elements of the yarn transfer and yarn guide members may be cut away or apertured to provide the pathway for the beam and in the embodiment of the invention hereinafter to be described, the end faces of the guide elements of the yarn guide member and the end faces of the guide elements of the yarn transfer member are formed with registering complementary open channels which together provide the pathway therethrough.

In the embodiment of the invention hereinafter to be described, the yarn or yarns fed to each eyelet element are protected in the region of the eyelet element on the supply side of the device by a protective sheath and the protective sheath is in the form of a tubular sleeve through which the yarn or yarns supplied to the eyelet element pass and which in operation of the device abuts at one end against the eyelet element. Separator arms are employed with the device on the supply side thereof to ensure proper formation of a shed being formed and wherein the protective sleeve is so dimensioned as to protect yarns from frictional forces imposed by the arms.

In the embodiment of the invention hereinafter to be described, each of the guide elements of each of the yarn transfer and yarn guide members is in the form of a guide pin the end of which terminates in an inclined end face which in each of the transfer positions opposes a complementary inclined end face on a registering guide pin on the other member.

BRIEF DESCRIPTION OF THE DRAWINGS

Embodiments of the invention will now be described by way of example with reference to the accompanying drawings in which.

DESCRIPTION OF THE PREFERRED EMBODIMENTS

Figure 3B:
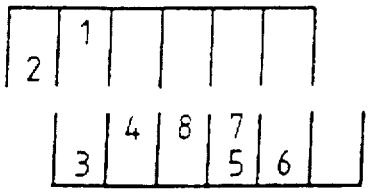
Fig.3B(v) PRIOR ART
FIGS. 3A(i) to 3H(viii) (hereinbefore referred to) are schematic diagrams of a yarn transfer mechanism of the machine shown in FIG. 2, illustrating successive yarn transfer steps in the transfer of yarns in the production of two superposed non-woven bias yarn sub-assemblies of the yarn structure shown in FIG. 1.
Figure 3B:
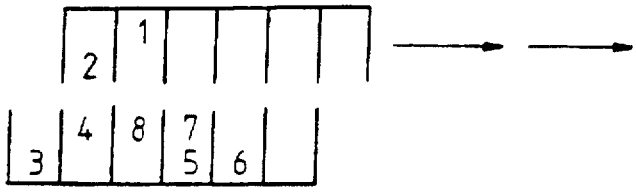
Fig.3B(v) PRIOR ART
Figure 3B:
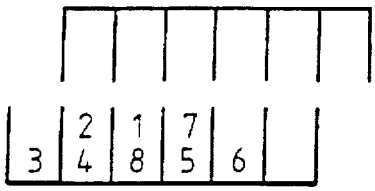
Fig.3B(v) PRIOR ART
Figure 3B:
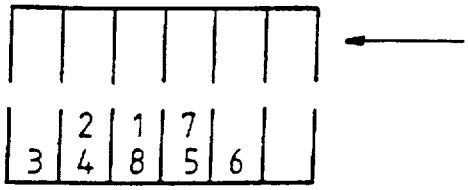
Fig.3B(v) PRIOR ART
Figure 3C:
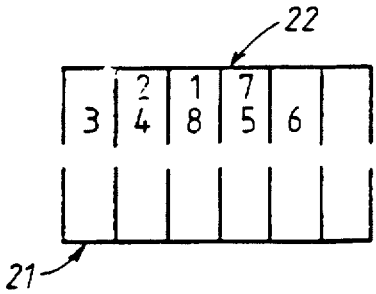
Fig.3C(i) PRIOR ART
Figure 3C:
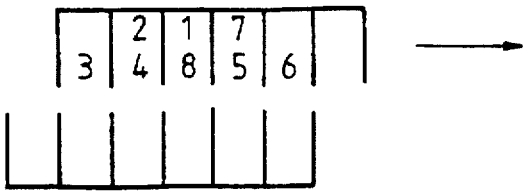
Fig.3C(i) PRIOR ART
Figure 3E:
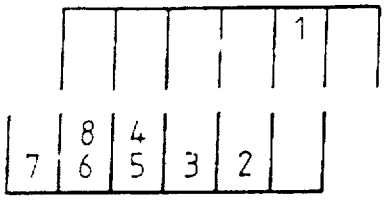
Fig.3E(v) PRIOR ART
Figure 3E:
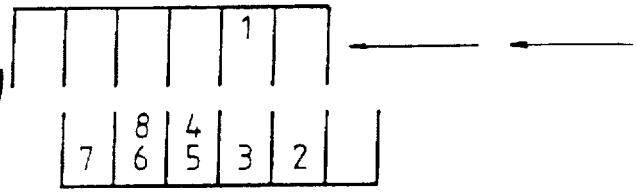
Fig.3E(v) PRIOR ART
Figure 3E:
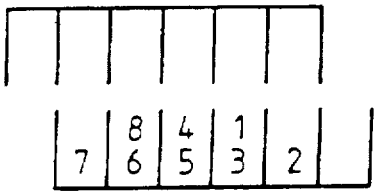
Fig.3E(v) PRIOR ART
Figure 3E:
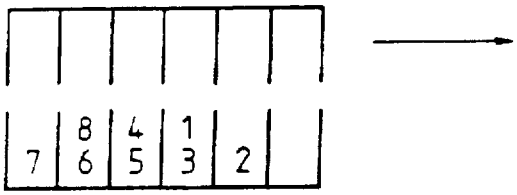
Fig.3E(v) PRIOR ART
Figure 3F:
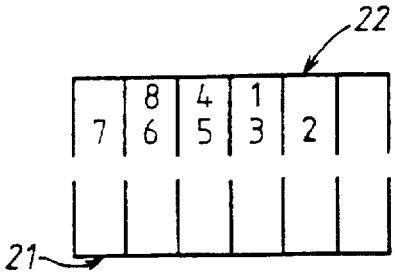
Fig.3F(i) PRIOR ART
Figure 3F:
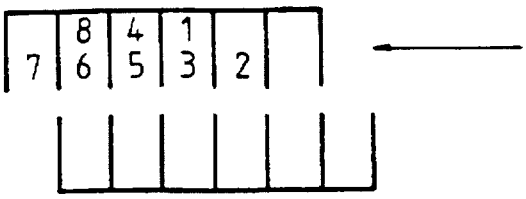
Fig.3F(i) PRIOR ART
Figure 3G:
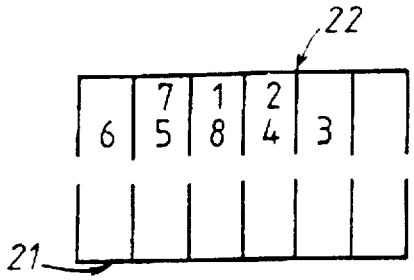
Fig.3G(i) PRIOR ART
Figure 3G:
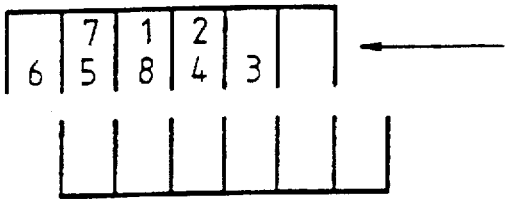
Fig.3G(v) PRIOR ART
Figure 3G:
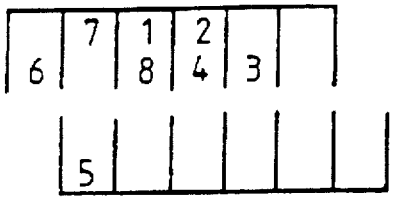
Fig.3G(v) PRIOR ART
Figure 3G:
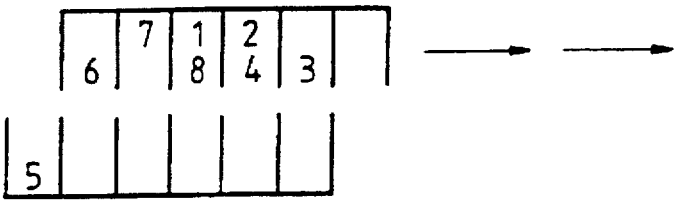
Fig.3G(v) PRIOR ART
Figure 3G:
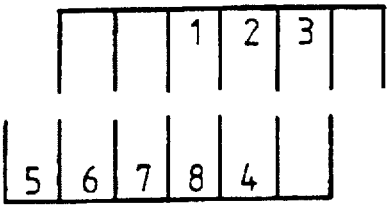
Fig.3G(v) PRIOR ART
Figure 4:
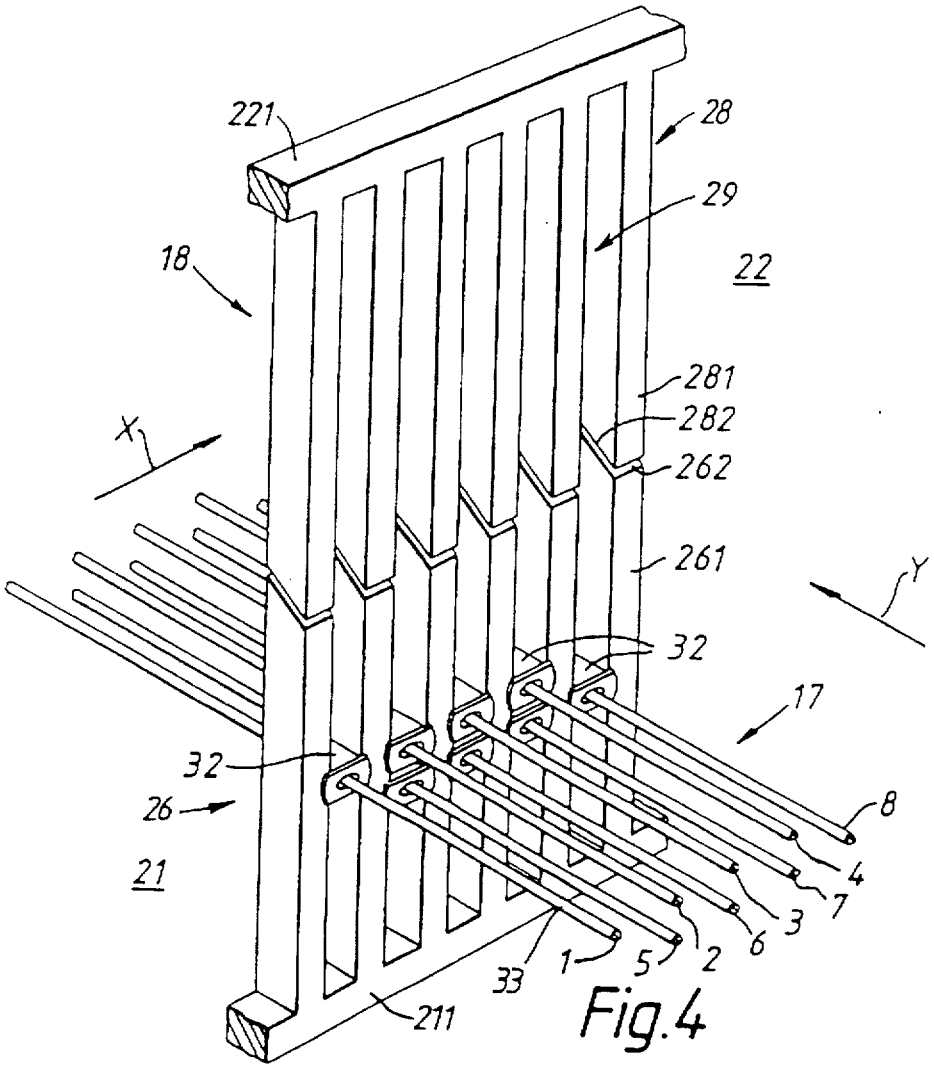
FIG. 4 is a schematic isometric view of a part of a bias yarn forming device according to the invention, illustrating a default disposition for the device in which yarn guide elements of the yarn transfer and yarn guide members are in registration and in which eyelet elements carrying the warp yarns are located in the openings in the yarn guide member.

Referring now to FIG. 4, it will be seen that the guide elements 26 of the yarn guide member 21 as disclosed in PCT/GB94/00028 and as illustrated in FIG. 3A(i) are in the form of guide pins 261 which are of rectangular cross-section and which form a row of equi-spaced pins lying in a vertical plane extending in the weft direction and extending upwardly from a support portion 211. While only six of the guide pins 261 are shown in FIG. 4, it will be appreciated that for most purposes a large plurality of such pins would be required in the production of a bias yarn assembly of practical use, for example, in the formation of a reinforcing fabric for an aircraft composite structural element.

It will furthermore be seen that the guide elements 28 of the yarn transfer member 22 as disclosed in PCT/GB94/00028 are in the form of pins 281 which are of rectangular cross-section and which have the same dimensions and dispositions as the guide elements 261 of the yarn guide member 21. As illustrated, they extend downwardly from a support portion 221 and form a row of guide elements which lie in a vertical plane which extends in the weft direction and which is co-planar with the vertical plane of the guide elements 261.

The yarn guide member 21 in the embodiment illustrated in FIG. 4 is a fixed member and a yarn transfer drive mechanism 181 is provided for the displacement of the yarn transfer member 22 in the weft direction X to bring the pins of the transfer member 22 to any one of a plurality of transfer positions, for example as illustrated in FIGS. 6A(ii), 6A(iv) and 6A(vi) as hereinafter to be described.

In addition, it will be seen from FIG. 4 that the end of each guide pin 261 terminates in an inclined end face 262 which in the position shown in FIG. 4 opposes a complementary inclined end face 282 on the end of a registering guide pin 281 of the yarn transfer member 22.

The device as illustrated in FIG. 4 and in accordance with the invention furthermore includes a plurality of eyelet elements 32 each of which carries one of eight warp yarns 1 to 8 supplied as a warp sheet 17 and delivered in the warp feed direction indicated by the arrow Y in FIG. 4 by the supply creel 16 described with reference to FIG. 2.

Figure 5:
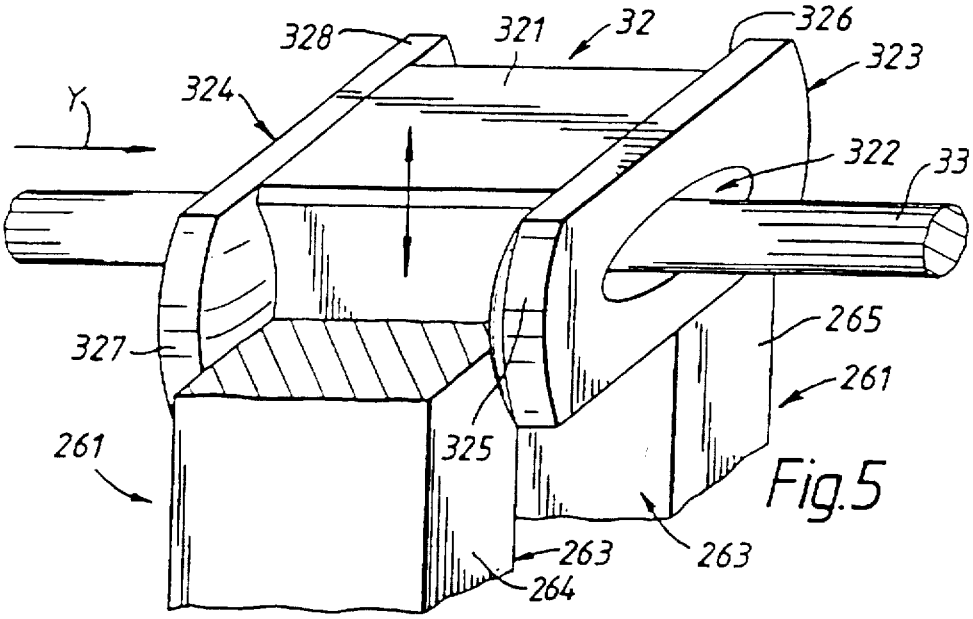
FIG. 5 is a schematic isometric view of one of the eyelet elements illustrated in FIG. 4 with parts of the guide elements broken away to reveal the structure of the eyelet element, and FIGS. 6A(i) to 6A(viii) are schematic isometric views of the device as illustrated in FIGS. 4 and 5 illustrating the transfer of the eyelet elements and the warp yarns carried by them during the first forward transfer step described with reference to and as illustrated in FIGS. 3A(i) to 3A(viii)

As can be seen from FIG. 5, each eyelet element 32 comprises a body portion 321 having a bore 322 which extends therethrough and through which one of the warp yarns 1 to 8 passes in the warp feed direction indicated by the arrow Y shown in FIG. 5. The body portion 321 is of rectangular section and is of such a width as to produce a sliding fit between the opposing side faces 263 of the guide pins 261.

The body portion 321 of the eyelet element 32 is provided at its front face with a front end flange 323 and at its rear face with a rear end flange 324. The front end flange 323 has a first pin engaging portion 325 which extends laterally from the body portion to overlap and bear against a front face 264 of one of the pins 261 and a second pin engaging portion 326 which extends laterally from the body portion 321 in an opposite direction to overlap and bear against the front face 265 of the other guide pin 261. The pin engaging portions 325 and 326 of the front end flange 323 have, as shown, pin contacting surfaces of convex form to facilitate movement of the eyelet element 32 into and out of the openings between adjacent guide pins and during transfer of the eyelet element from an opening in one of the members 21 and 22 to an opening in the other member. The rear end flange 324 of the eyelet element 32 is formed in the same manner as the front end flange 323 to provide pin engaging portions 327 and 328 which overlap and bear against the rear faces of the guide pins 261. The pin engaging portions 327 and 328 have pin contacting surfaces of convex form to facilitate movement of the eyelet element 32.

As will be seen from FIG. 5, the bore 322 through which a warp yarn passes enlarges continuously in the region of the front of the bore so as to reduce the frictional force applied by the walls of the bore to the yarn 33 passing through the bore. The rear end of the bore may also be continuously enlarged.

Referring now to FIG. 6A(i), it will be seen that the disposition of the yarn transfer member 22 and the yarn guide member 21 are as illustrated in FIG. 4. The warp yarns 1 to 8 together with the eyelet elements 32 through which they pass have however been moved to occupy openings in the yarn transfer member 22. This movement is achieved by raising all the yarns 1 to 8 simultaneously in a shedding operation, during which the yarns cause the eyelet elements 32 to slide along the pins 261, across the gap between the ends of the pins 261 and the ends of the pins 281 and into the openings between the pins 281. During this movement, the yarns 33 are protected by the eyelet elements 32 and abrasion of them during this movement, particularly during the transfer across the ends of the pins 261 and 281 is markedly reduced.

The yarn transfer member 22 is then moved as illustrated in FIG. 6A(ii) in the weft direction one opening to the right, following which yarns 5, 6 and 7 are lowered as illustrated in FIG. 6A(iii), causing the eyelet elements 32 through which they pass to slide downwardly within their openings and take up positions in openings in the yarn guide member 21. The yarn transfer member 22 is then moved two openings to the left to take up the position illustrated in FIG. 6A(iv), following which the yarns 2, 3, 4 and 8 are lowered to bring the eyelet elements 32 through which they pass from the openings in the yarn transfer member 22 to registering openings in the yarn guide member 21 as illustrated in FIG. 6A(v). At this point the first yarn 1 remains in the yarn transfer member 22, which is then moved in the weft direction two openings to the right as illustrated in FIG. 6A(vi) following which yarn 1 is lowered into the yarn guide member 21 as illustrated in FIG. 6A(vii), bringing with it the eyelet element 32 through which it passes. The yarn transfer member 22 is then moved in the weft direction one opening to the left as illustrated in FIG. 6A (viii).

It will be appreciated that although each of the yarns 1 to 8 are required to be moved from openings in the yarn guide member 21 into openings in the yarn transfer member 22 and then back to openings in the yarn guide member 21, the yarns are protected by the eyelet elements 32 through which they pass.

It is to be noted that the movements of the yarns and their eyelet elements as described with reference to FIG. 6A(i) to FIG. 6A(viii) constitute only the first of four forward transfer steps which are followed by four return transfer steps. Furthermore, although movements of eight yarns 1 to 8 have been described, in a practical application each of the forward and return transfer steps would be carried out on a large plurality of warp yarns.

It will furthermore be appreciated that by arranging for the bores 322 of the eyelet elements 32 to be flared out at each end, the angular deflections in vertical and horizontal planes of the yarns at the inlets to the bore 322 produced by shedding of the yarns and inclining of the bias yarns in the warp sheet and in a vertical plane at the exits to the bores 322 resulting from the shedding of the bias yarns can be well accommodated and abrasion of the yarns in their passage through the device substantially reduced.

While in the description of FIGS. 6A(i) to FIG. 6A(viii) the yarns 1 to 8 have been taken to be single warp yarns of the warp sheet with one eyelet element for each yarn, it will be apparent that for some applications of the device each or one or more of the eyelet elements may be traversed by two or more yarns.

It will be appreciated that although the guiding surfaces of the eyelet elements 32 are so shaped as to reduce to a minimum frictional forces occurring during their sliding movements along the pins 261 and 281 of the yarn guide and transfer members 21 and 22 as well as to provide for their riding easily across the junctions between the ends of the pins on the member 21 and the ends of the pins on the member 22, there is always a remote possibility of one of the eyelets 32 being caught up and held at one of the junctions, which if undetected would prevent displacement of the yarn transfer member 22 in the weft direction in carrying out the next yarn transfer step and give rise to malfunction of the machine and possible damage to the pins.

Figure 7:
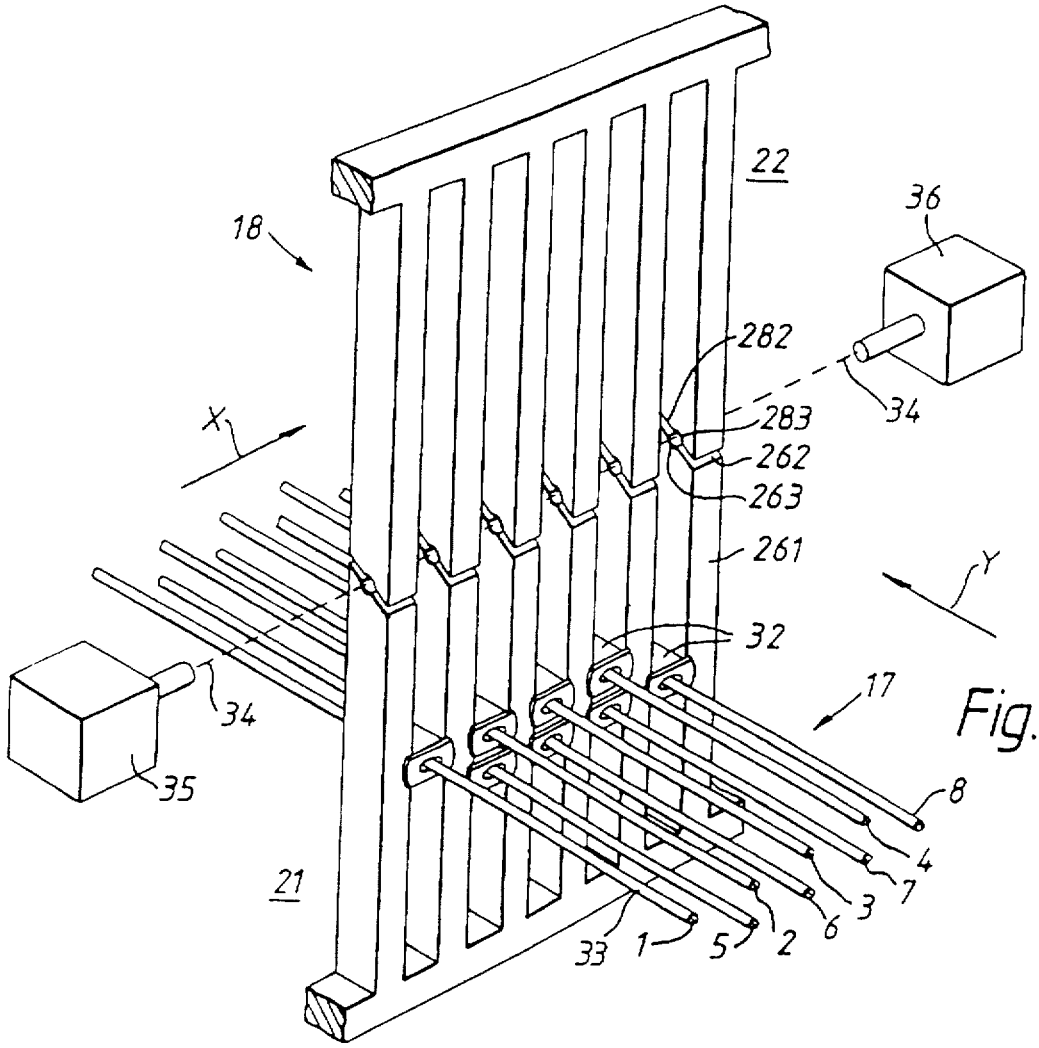
FIG. 7 is a schematic isometric view of part of a bias yarn forming device according to the invention, which includes an eyelet detection device detecting any faulty retention of an eyelet element at the junction between the aligned ends of the yarn guide elements of the yarn transfer and yarn guide members.
Figure 8:
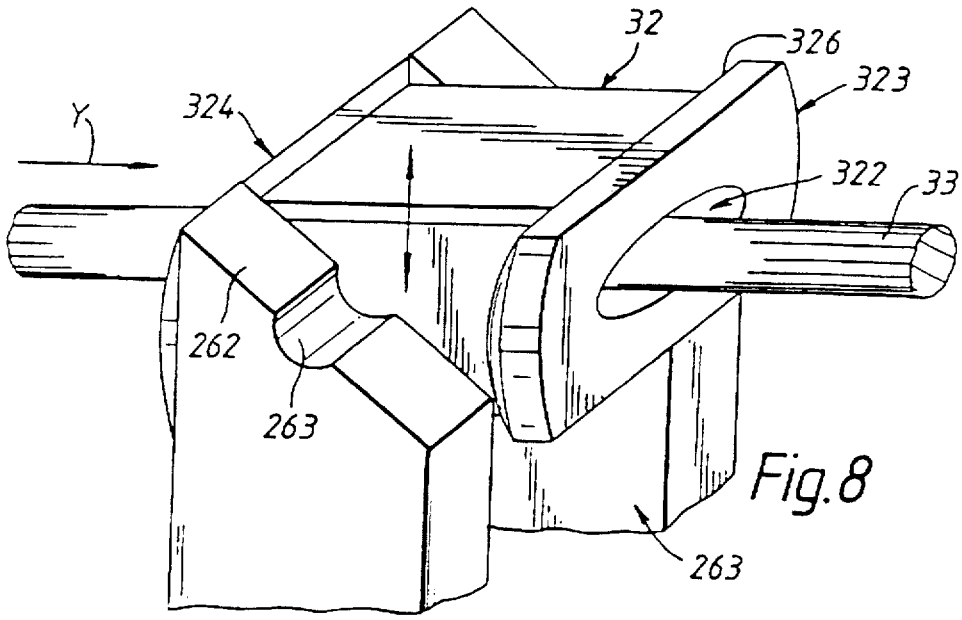
FIG. 8 is a schematic isometric view showing in detail the form of the end of each yarn guide element of the yarn guide member device shown in FIG. 7 and an eyelet element located in the region of the end.

An eyelet detector mechanism for detecting the presence of an eyelet element at the junction between the ends of the pins 261 and 281 is shown in FIGS. 7 and 8. As will be seen, the inclined end faces 262 and 282 of each of the pins 261 and 281 are formed with semi-cylindrical channels 263 and 283 as best seen in FIG. 8 which provide a pathway for an optical beam 34. The beam 34 is generated by a beam generator 35 located at one end of the transfer mechanism 18 and is arranged to be received by a beam responsive device 36 located at the other end of the mechanism 18.

Figure 1:
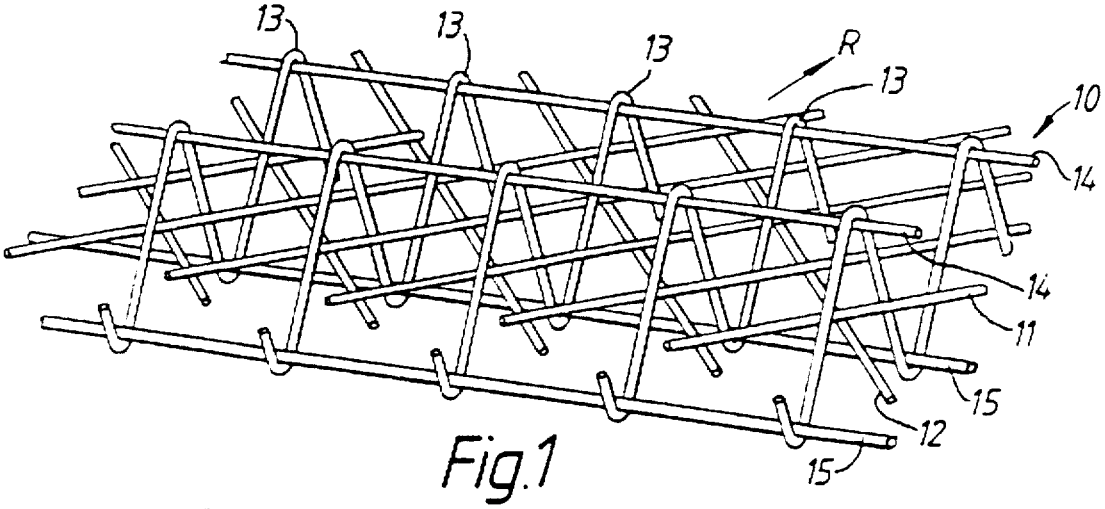
Fig.1 PRIOR ART
FIG. 1 (hereinbefore referred to) is a schematic perspective view of a three-dimensional yarn structure produced by a yarn structure forming machine disclosed in PCT/GB94/00028.
Figure 2:
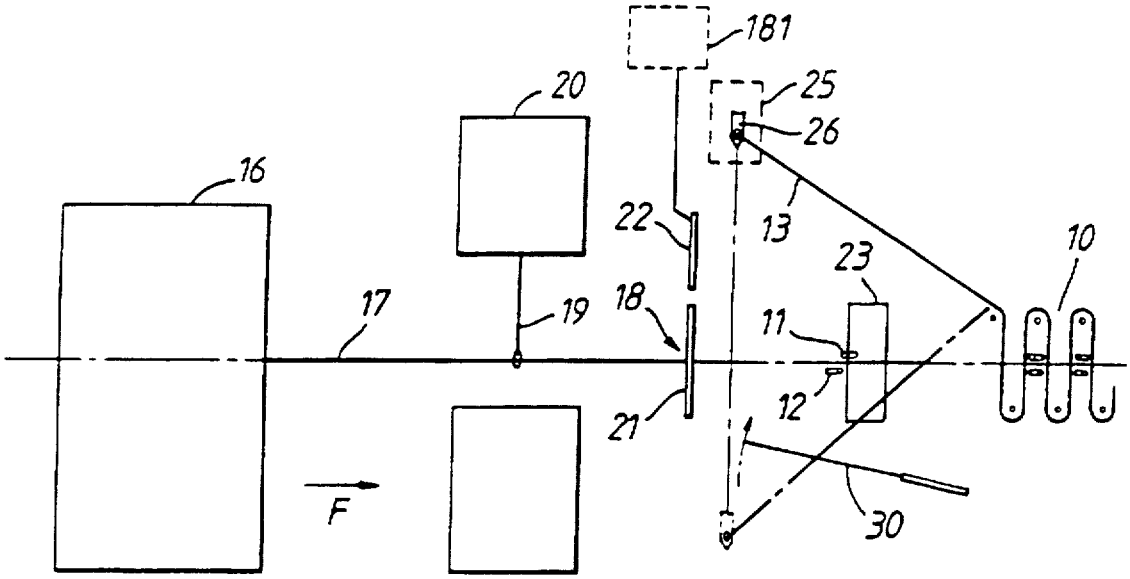
Fig. 2 PRIOR ART
FIG. 2 (hereinbefore referred to) is a block schematic diagram of the yarn structure forming machine disclosed in PCT/GB94/00028 for forming the yarn structure illustrated in FIG. 1.

Transmission of the beam 34 is maintained during the operation of the machine shown in FIG. 2, with the beam responsive device 36 generating stop motion signals in response to and for the duration of an interruption of the beam arising from the presence of an eyelet element 32 at a junction between the ends of the pins 261 and 281. Stop motion signals will thus be generated during each movement of an eyelet element 32 through a junction during a transfer of the eyelet element from one of the members 21 and 22 to the other, but will discontinue in normal operation of the machine when the eyelet elements have been properly transferred from one member to the other prior to displacement of the member 22. When however an eyelet element 32 is caught at the junction between the ends of the aligned pins 261 and 281 the interruption in the beam transmission produces a continuing stop signal indicating a requirement to prevent the next movement of the yarn transfer member 22. The stop signal thus maintained is applied to control logic which then prevents energisation of the drive mechanism 181 and stops the machine described with reference to FIG. 2. The control arrangements are made such that restarting of the machine and the drive mechanism 181 takes place only upon removal of the obstructing eyelet element 32 and the activation of a restart control.

In the eyelet detector mechanism illustrated in FIGS. 7 and 8 a single beam is transmitted for detecting the presence of an eyelet element at the junction between the ends of the pins 261 and 281. It may however be advantageous to provide for the transmission and reception of an additional beam extending along the supply side and/or an additional beam extending along the delivery side of the pins 261 and 281 to detect the presence of an eyelet element 32 in the vicinity of a junction between the ends of the pins 261 and 281 where the eyelet element is arrested in a position which does not give rise to an interruption of the main beam 34.

It will be apparent that the yarns are adequately protected by the eyelet elements 32 against excessive frictional forces in their passage along the pins 261 and 281 and against snagging during passage across the junctions between the aligned ends of the pins 261 and 281. Where circumstances require that separator arms are provided at the supply side of the transfer mechanism 18 which pass through a shed being formed to ensure that all the yarns are properly shed, it has been found advantageous to provide additional protection for the yarns. One form of protection will now be described with reference to FIGS. 9 and 10.

Figure 9:
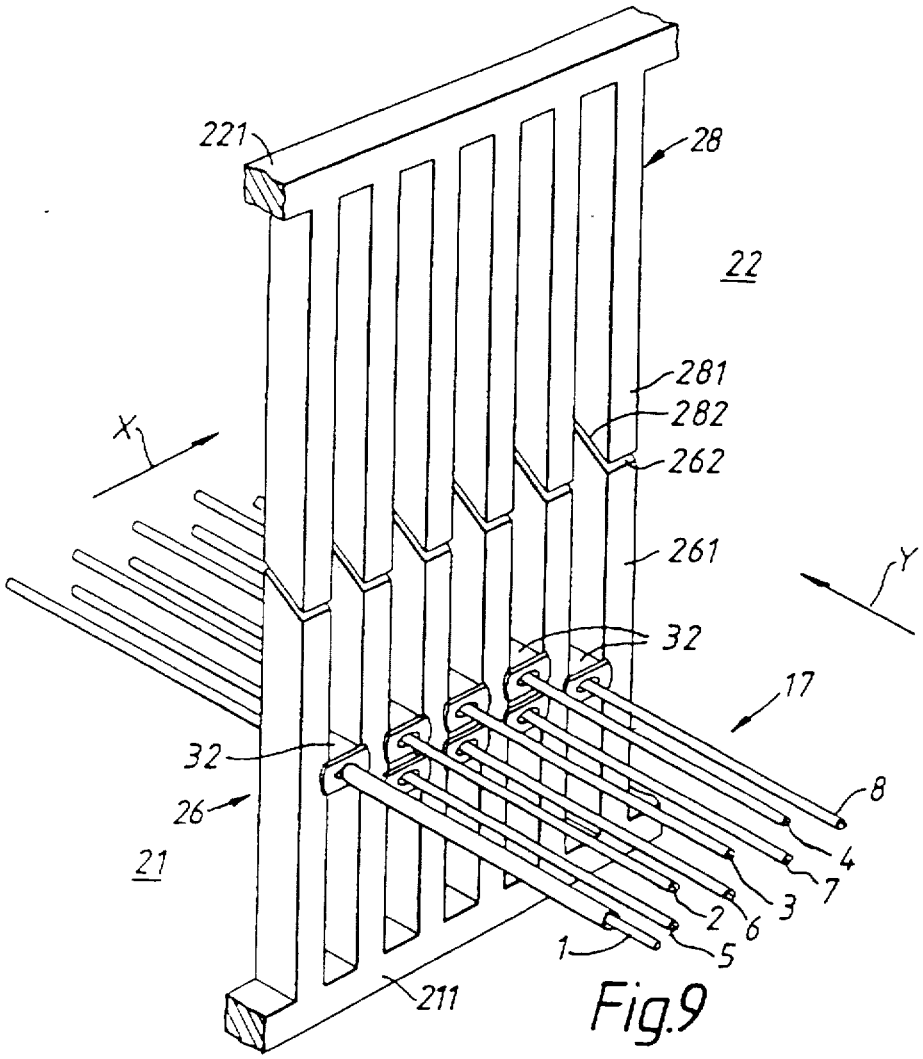
FIG. 9 is a schematic isometric view of the part of the bias yarn forming device illustrated in FIG. 4, showing the use of a protective sheath for protecting yarn at the yarn supply side of the device.
Figure 10:
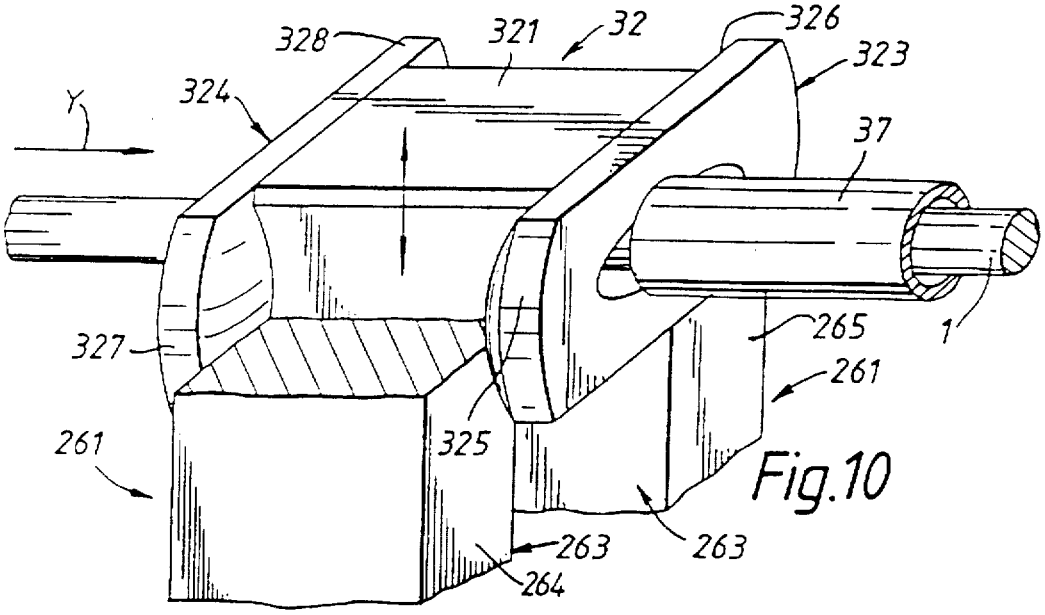
FIG. 10 is a schematic isometric view of one of the eyelet elements as illustrated in FIG. 9 showing to an enlarged scale the disposition of the protective sheath in relation to the yarn entry zone to the eyelet element.

It will be seen from FIGS. 9 and 10 that the transfer mechanism 18 and the eyelet elements 32 take the same form as those illustrated in and described with reference to FIGS. 4 and 5, except insofar that further protection for the yarn or yarns supplied to each eyelet element 32 is provided by a protective sheath, one of which is illustrated in FIGS. 9 and 10 as sheath 37 which protects the yarn or yarns 1, the yarns at the other eyelet elements being protected in the same manner by identical sheaths (not shown). As will be seen from FIG. 10 the sheath 37 encompasses the yarn or yarns 1 and during advancement of the yarn through the eyelet element 32 abuts at its front end against the face of the flange 323 of the eyelet element 32. The protective sheaths 37 are arranged to be of such a length as to protect the yarns from the separator arms when these are advanced weft-wise to ensure proper formation of the shed being formed.

In the embodiment of the invention hereinbefore described with reference to FIGS. 4 to 10 of the drawings, it will be seen that the pins 261 and 281 are of rectangular cross-section. It will however be appreciated that cross-sections other than rectangular may alternatively be employed provided that they hold the eyelet elements 32 captive for sliding movement along the pins in the spaces between adjacent pins.

I claim:

1. A bias yarn assembly forming device for forming in a succession of bias yarn forming steps in which warp yarns being fed in a warp sheet in a warp feed direction from a supply side of the device are displaced in opposite weft directions, a bias yarn assembly comprising two superposed bias yarn sub-assemblies in which the bias yarns of one sub-assembly are inclined to the bias yarns of the other sub-assembly and in both of which the bias yarns are inclined to the warp feed direction, the device including: a yarn transfer mechanism comprising a yarn guide member having a support portion extending in the weft direction and a plurality of first guide elements which extend laterally from the support portion to form a row of equi-spaced first guide elements which terminate in ends lying on a line extending in the weft direction and which define between pairs of adjacent first guide elements warp yarn guide openings through which warp yarns of the warp sheet are caused to pass and by which the warp yarns are confined to predetermined relative positions therein along the weft direction, and a yarn transfer member having a support portion extending in the weft direction and a plurality of second guide elements which extend laterally from the support portion to form a row of equi-spaced second guide elements which terminate in ends lying on a line extending in the weft direction and which define between pairs of adjacent second guide elements yarn transfer openings to which warp yarns of the warp sheet are transferred and by which the warp yarns are confined to predetermined relative positions therein along the weft direction, yarn transfer drive means to cause predetermined relative displacements of the yarn transfer member and the yarn guide member in the weft direction to bring the yarn transfer member to any one of a plurality of transfer positions in which ends of the guide elements of the yarn transfer member oppose and register with ends of the guide elements of the yarn guide member and in which transfer openings of the yarn transfer member register with yarn guide openings in the yarn guide member and shedding means on the supply side of the transfer mechanism for shedding selected warp yarns to cause the selected yarns to move from predetermined first yarn guide openings in the yarn guide member to registering yarn transfer openings in the yarn transfer member and following displacement of the yarn transfer member to another of the plurality of the transfer positions to return the selected warp yarns to the warp sheet and into predetermined second yarn guide openings in the yarn guide member offset from the predetermined first yarn guide openings the device being characterized in that:

the transfer mechanism includes a plurality of eyelet elements through which the warp yarns of the warp sheet pass from the supply side of the device to an opposite delivery side of the device, said eyelet elements including means for being supported by the guide elements for sliding movement along the elements into and out of the yarn guide and yarn transfer openings and for sliding movements from one opening in one member into a registering opening in the other member when the yarn transfer member is in any one of the registering positions.

2. A device according to claim 1 wherein the first guide elements of the yarn guide member lie in a first surface, wherein the second guide elements of the yarn transfer member lie in a second surface and wherein the yarn transfer member and yarn guide member are so disposed at each of the transfer positions that the first and second surfaces form a continuous surface.

3. A device according to claim 2 wherein the first and second surfaces in which the first and second guide elements of the yarn transfer member and yarn guide member lie are planar and wherein the yarn transfer and yarn guide members are so disposed that the first and second planar surfaces are co-planar at each transfer position.

4. A device according to claim 3 wherein the yarn transfer and yarn guide members are mounted for relative displacement to cause the first and second planar surfaces in which the first and second guide elements of the two members lie to be co-planar throughout the predetermined relative displacement of the two members.

5. A device according to claim 4 wherein each eyelet element includes a body portion having a bore which extends therethrough and through which one or more warp yarns pass and restraining means restraining the eyelet element to sliding movement on the guide elements in the opening within which the eyelet element is located.

6. A device according to claim 5 wherein the restraining means comprises a front end flange provided on the supply side of the device and having:

a first guide element engaging portion which extends laterally from the body portion in a first direction to overlap and bear against a front face of one of the two adjacent guide elements which define the opening in which the eyelet element is located and a second guide element engaging portion which extends laterally from the body portion in an opposite direction to overlap and bear against the front face of the other of the two adjacent guide elements defining the opening.

7. A device according to claim 6 wherein the restraining means further comprises a rear end flange provided on the delivery side of the device and having:

a first guide element engaging portion which extends laterally from the body portion in a first direction to overlap and bear against a rear face of one of the adjacent guide elements which define the opening in which the eyelet element is located and a second guide element engaging portion which extends laterally from the body portion in an opposite direction to overlap and bear against the other of the adjacent guide elements defining the opening.

8. A device according to claim 7 wherein the body portion of the eyelet element extends laterally within the opening in which the eyelet element is located to prevent any weftwise or any substantial weftwise movement of the eyelet element within the opening.

9. A device according to claim 1 wherein the guide element engaging portions of each end flange of each eyelet element, which overlap and bear against the front and rear faces of adjacent guide elements, have guide element engaging surfaces of convex form to facilitate movement of the eyelet element into and out of the openings between adjacent guide elements during transfer of the eyelet element from an opening in one member to an opening in the other member.

10. A device according to claim 1 wherein said eyelet element includes a body portion with a bore therein, wherein said bore enlarges continuously in the region of each end of the bore to reduce the frictional force applied by the walls of the bore to the warp yarns passing through the bore.

11. A device according to claim 1 wherein:

each of the first and second guide elements of the yarn transfer member and the yarn guide member are of square or rectangular cross-section, the body portion of each eyelet element is of rectangular or square section and the body portion of each of the eyelet elements has a width to produce a sliding fit between opposing side faces of adjacent guide elements which define the opening in which the eyelet element lies.

12. A device according to claim 1 comprising an eyelet element detection device responsive to a retention of an eyelet element at a junction between any one of the yarn guide openings and a transfer opening in registration therewith to prevent a subsequent relative displacement of the yarn transfer and yarn guide members until the eyelet element has been cleared from the junction.

13. A device according to claim 12 wherein the detection device comprises a beam generator and a beam responsive device so disposed that the beam generator transmits a beam to the beam responsive device along a pathway in which the beam is interrupted by the presence of an eyelet element at any of the junctions.

14. A device according to claim 13 wherein the first and second guide elements of the yarn transfer and yarn guide members are cut away or apertured to provide the pathway for the beam.

15. A device according to claim 14 wherein the end faces of the first guide elements of the yarn guide member and the end faces of the second guide elements of the yarn transfer member are formed with registering complementary open channels which together provide the pathway therethrough.

16. A device according to claim 1 wherein the yarn or yarns fed to each eyelet element are protected in the region of the eyelet element on the supply side of the device by a protective sheath.

17. A device according to claim 16 wherein the protective sheath is in the form of a tubular sleeve through which the yarn or yarns supplied to the eyelet element pass and which in operation of the device abuts at one end against the eyelet element.

18. A device according to claim 17 wherein separator arms are employed with the device on the supply side thereof to ensure proper formation of a shed being formed and wherein the protective sleeve is so dimensioned as to protect yarns from frictional forces imposed by the arms.

19. A device according to claim 1 wherein each of the guide elements of each of the yarn transfer and yarn guide members is in the form of a guide pin the end of which terminates in an inclined end face which in each of the transfer positions opposes a complementary inclined end face on a registering guide pin on the other member.

* * * * *